US008873984B2

(12) United States Patent
Ishii et al.

(10) Patent No.: US 8,873,984 B2
(45) Date of Patent: Oct. 28, 2014

(54) FIXING DEVICE, IMAGE FORMING APPARATUS INCORPORATING SAME, AND FIXING METHOD

(71) Applicants: Kenji Ishii, Kanagawa (JP); Yuji Arai, Kanagawa (JP); Yoshiki Yamaguchi, Kanagawa (JP); Arinobu Yoshiura, Kanagawa (JP); Toshihiko Shimokawa, Kanagawa (JP); Masaaki Yoshikawa, Tokyo (JP); Hiromasa Takagi, Tokyo (JP); Akira Suzuki, Tokyo (JP); Naoki Iwaya, Tokyo (JP); Takahiro Imada, Kanagawa (JP); Hajime Gotoh, Kanagawa (JP); Tadashi Ogawa, Tokyo (JP); Kensuke Yamaji, Kanagawa (JP); Teppei Kawata, Kanagawa (JP)

(72) Inventors: Kenji Ishii, Kanagawa (JP); Yuji Arai, Kanagawa (JP); Yoshiki Yamaguchi, Kanagawa (JP); Arinobu Yoshiura, Kanagawa (JP); Toshihiko Shimokawa, Kanagawa (JP); Masaaki Yoshikawa, Tokyo (JP); Hiromasa Takagi, Tokyo (JP); Akira Suzuki, Tokyo (JP); Naoki Iwaya, Tokyo (JP); Takahiro Imada, Kanagawa (JP); Hajime Gotoh, Kanagawa (JP); Tadashi Ogawa, Tokyo (JP); Kensuke Yamaji, Kanagawa (JP); Teppei Kawata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 61 days.

(21) Appl. No.: 13/790,518

(22) Filed: Mar. 8, 2013

(65) Prior Publication Data

US 2013/0251390 A1 Sep. 26, 2013

(30) Foreign Application Priority Data

Mar. 22, 2012 (JP) ..... 2012-064613

(51) Int. Cl.
*G03G 15/20* (2006.01)

(52) U.S. Cl.
CPC ..... *G03G 15/205* (2013.01); *G03G 2215/2035* (2013.01)
USPC ..... 399/67; 399/69; 399/328; 399/329

(58) Field of Classification Search
USPC ..... 399/38, 67–69, 107, 110, 122, 320, 399/328–334
See application file for complete search history.

(56) References Cited

U.S. PATENT DOCUMENTS

| | | | | |
|---|---|---|---|---|
| 8,588,670 | B2 * | 11/2013 | Shimokawa et al. | 399/334 |
| 8,676,101 | B2 * | 3/2014 | Yoshikawa et al. | 399/320 |
| 2003/0165348 | A1 | 9/2003 | Amita et al. | |
| 2004/0013453 | A1 | 1/2004 | Shinshi et al. | |
| 2004/0179875 | A1 | 9/2004 | Iwata et al. | |
| 2005/0074251 | A1 | 4/2005 | Katoh et al. | |
| 2005/0129432 | A1 | 6/2005 | Sato et al. | |
| 2005/0163543 | A1 | 7/2005 | Satoh et al. | |
| 2006/0029411 | A1 | 2/2006 | Ishii et al. | |

(Continued)

FOREIGN PATENT DOCUMENTS

| | | |
|---|---|---|
| JP | 2004-246083 | 9/2004 |
| JP | 2007-334205 | 12/2007 |

(Continued)

*Primary Examiner* — Hoan Tran
(74) *Attorney, Agent, or Firm* — Oblon, Spivak, McClelland, Maier & Neustadt, L.L.P.

(57) ABSTRACT

A fixing device includes a fixing rotary body rotatable in a predetermined direction of rotation and a heater disposed opposite and heating a heating span of the fixing rotary body. A controller is operatively connected to a power supply that supplies power to the heater and a driver that rotates the fixing rotary body to control the power supply and the driver. The controller performs at least one of a rotation speed control that controls the driver to rotate the fixing rotary body at an increased rotation speed and a power supply control that controls the power supply to supply an increased amount of power to the heater.

20 Claims, 12 Drawing Sheets

(56) References Cited

U.S. PATENT DOCUMENTS

| | | | |
|---|---|---|---|
| 2006/0116230 | A1 | 6/2006 | Satoh et al. |
| 2006/0165429 | A1 | 7/2006 | Satoh et al. |
| 2006/0165443 | A1 | 7/2006 | Yoshinaga et al. |
| 2006/0177232 | A1 | 8/2006 | Ehara et al. |
| 2006/0285893 | A1 | 12/2006 | Ishii |
| 2007/0014600 | A1 | 1/2007 | Ishii et al. |
| 2007/0014603 | A1 | 1/2007 | Satoh et al. |
| 2007/0025754 | A1 | 2/2007 | Takagi |
| 2007/0059011 | A1 | 3/2007 | Seo et al. |
| 2007/0166083 | A1 | 7/2007 | Satoh et al. |
| 2007/0212089 | A1 | 9/2007 | Seo et al. |
| 2007/0242988 | A1 | 10/2007 | Seo et al. |
| 2007/0280754 | A1 | 12/2007 | Ogawa et al. |
| 2007/0292175 | A1 | 12/2007 | Shinshi |
| 2008/0025772 | A1 | 1/2008 | Seo et al. |
| 2008/0025773 | A1 | 1/2008 | Ito et al. |
| 2008/0044196 | A1 | 2/2008 | Seo et al. |
| 2008/0175633 | A1 | 7/2008 | Shinshi |
| 2008/0219721 | A1 | 9/2008 | Ito et al. |
| 2008/0226326 | A1 | 9/2008 | Seo et al. |
| 2008/0232873 | A1 | 9/2008 | Ueno et al. |
| 2008/0317532 | A1 | 12/2008 | Ehara et al. |
| 2009/0123201 | A1 | 5/2009 | Ehara et al. |
| 2009/0148204 | A1 | 6/2009 | Yoshinaga et al. |
| 2010/0074667 | A1 | 3/2010 | Ehara et al. |
| 2010/0290822 | A1 | 11/2010 | Hasegawa et al. |
| 2010/0303521 | A1 | 12/2010 | Ogawa et al. |
| 2011/0026988 | A1 | 2/2011 | Yoshikawa et al. |
| 2011/0044706 | A1 | 2/2011 | Iwaya et al. |
| 2011/0044734 | A1 | 2/2011 | Shimokawa et al. |
| 2011/0052237 | A1 | 3/2011 | Yoshikawa et al. |
| 2011/0052245 | A1 | 3/2011 | Shinshi et al. |
| 2011/0052277 | A1 | 3/2011 | Ueno et al. |
| 2011/0052282 | A1 | 3/2011 | Shinshi et al. |
| 2011/0058862 | A1 | 3/2011 | Yamaguchi et al. |
| 2011/0058863 | A1 | 3/2011 | Shinshi et al. |
| 2011/0058864 | A1 | 3/2011 | Fujimoto et al. |
| 2011/0058865 | A1 | 3/2011 | Tokuda et al. |
| 2011/0058866 | A1 | 3/2011 | Ishii et al. |
| 2011/0064443 | A1 | 3/2011 | Iwaya et al. |
| 2011/0064450 | A1 | 3/2011 | Ishii et al. |
| 2011/0064451 | A1 | 3/2011 | Yamaguchi et al. |
| 2011/0064490 | A1 | 3/2011 | Imada et al. |
| 2011/0064502 | A1 | 3/2011 | Hase et al. |
| 2011/0076071 | A1 | 3/2011 | Yamaguchi et al. |
| 2011/0085815 | A1 | 4/2011 | Kishi et al. |
| 2011/0085832 | A1 | 4/2011 | Hasegawa et al. |
| 2011/0091253 | A1 | 4/2011 | Seo et al. |
| 2011/0116848 | A1 | 5/2011 | Yamaguchi et al. |
| 2011/0129268 | A1 | 6/2011 | Ishii et al. |
| 2011/0150518 | A1 | 6/2011 | Hase et al. |
| 2011/0170917 | A1 | 7/2011 | Yoshikawa et al. |
| 2011/0176822 | A1 | 7/2011 | Ishii et al. |
| 2011/0182638 | A1 | 7/2011 | Ishii et al. |
| 2011/0194869 | A1 | 8/2011 | Yoshinaga et al. |
| 2011/0194870 | A1 | 8/2011 | Hase et al. |
| 2011/0200368 | A1 | 8/2011 | Yamaguchi et al. |
| 2011/0200370 | A1 | 8/2011 | Ikebuchi et al. |
| 2011/0206427 | A1 | 8/2011 | Iwaya et al. |
| 2011/0211876 | A1 | 9/2011 | Iwaya et al. |
| 2011/0217056 | A1 | 9/2011 | Yoshinaga et al. |
| 2011/0217093 | A1 | 9/2011 | Tokuda et al. |
| 2011/0217095 | A1 | 9/2011 | Ishii et al. |
| 2011/0222875 | A1 | 9/2011 | Imada et al. |
| 2011/0222876 | A1 | 9/2011 | Yuasa et al. |
| 2011/0222888 | A1 | 9/2011 | Ikebuchi et al. |
| 2011/0222926 | A1 | 9/2011 | Ueno et al. |
| 2011/0222929 | A1 | 9/2011 | Fujimoto et al. |
| 2011/0222930 | A1 | 9/2011 | Fujimoto et al. |
| 2011/0222931 | A1 | 9/2011 | Shinshi et al. |
| 2011/0222938 | A1 | 9/2011 | Watanabe et al. |
| 2011/0229161 | A1 | 9/2011 | Ueno et al. |
| 2011/0229162 | A1 | 9/2011 | Ogawa et al. |
| 2011/0229178 | A1 | 9/2011 | Ogawa et al. |
| 2011/0229181 | A1 | 9/2011 | Iwaya et al. |
| 2011/0229200 | A1 | 9/2011 | Yamaguchi et al. |
| 2011/0229225 | A1 | 9/2011 | Ishii et al. |
| 2011/0229226 | A1 | 9/2011 | Tokuda et al. |
| 2011/0229227 | A1 | 9/2011 | Yoshikawa et al. |
| 2011/0229228 | A1 | 9/2011 | Yoshikawa et al. |
| 2011/0229236 | A1 | 9/2011 | Ehara et al. |
| 2011/0274453 | A1 | 11/2011 | Shimokawa et al. |
| 2011/0311284 | A1 | 12/2011 | Seo et al. |
| 2012/0045226 | A1 | 2/2012 | Hase et al. |
| 2012/0051766 | A1 | 3/2012 | Ueno et al. |
| 2012/0051774 | A1 | 3/2012 | Ikebuchi et al. |
| 2012/0093531 | A1 | 4/2012 | Yuasa et al. |
| 2012/0093551 | A1 | 4/2012 | Ogawa et al. |
| 2012/0107005 | A1 | 5/2012 | Hase et al. |
| 2012/0114345 | A1 | 5/2012 | Fujimoto et al. |
| 2012/0114354 | A1 | 5/2012 | Saito et al. |
| 2012/0121303 | A1 | 5/2012 | Takagi et al. |
| 2012/0121304 | A1 | 5/2012 | Tokuda et al. |
| 2012/0121305 | A1 | 5/2012 | Yoshikawa et al. |
| 2012/0148303 | A1 | 6/2012 | Yamaguchi et al. |
| 2012/0155935 | A1 | 6/2012 | Yoshikawa et al. |
| 2012/0155936 | A1 | 6/2012 | Yamaguchi et al. |
| 2012/0177388 | A1 | 7/2012 | Imada et al. |
| 2012/0177393 | A1 | 7/2012 | Ikebuchi et al. |
| 2012/0177420 | A1 | 7/2012 | Shimokawa et al. |
| 2012/0177423 | A1 | 7/2012 | Imada et al. |
| 2012/0177424 | A1 | 7/2012 | Saito et al. |
| 2012/0207523 | A1 | 8/2012 | Ueno et al. |
| 2012/0219312 | A1 | 8/2012 | Yuasa et al. |
| 2012/0224878 | A1 | 9/2012 | Ikebuchi et al. |
| 2012/0237273 | A1 | 9/2012 | Yoshinaga et al. |
| 2013/0045032 | A1 | 2/2013 | Shimokawa et al. |

FOREIGN PATENT DOCUMENTS

| | | |
|---|---|---|
| JP | 2008-158482 | 7/2008 |
| JP | 2009-092887 | 4/2009 |
| JP | 2010-032625 | 2/2010 |
| JP | 2011-039397 | 2/2011 |

* cited by examiner

FIXING DEVICE, IMAGE FORMING APPARATUS INCORPORATING SAME, AND FIXING METHOD

CROSS-REFERENCE TO RELATED APPLICATION

This patent application is based on and claims priority pursuant to 35 U.S.C. §119 to Japanese Patent Application No. 2012-064613, filed on Mar. 22, 2012, in the Japanese Patent Office, the entire disclosure of which is hereby incorporated by reference herein.

BACKGROUND OF THE INVENTION

1. Field of the Invention

Exemplary aspects of the present invention relate to a fixing device, an image forming apparatus, and a fixing method, and more particularly, to a fixing device for fixing a toner image on a recording medium, an image forming apparatus incorporating the fixing device, and a fixing method performed by the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device is requested to shorten a warm-up time to warm up the fixing device and a first print time taken to output the recording medium bearing the toner image onto the outside of the image forming apparatus after the image forming apparatus receives a print job.

To address these requests, the fixing device may employ a thin fixing belt having a decreased thermal capacity and therefore heated quickly by a heater. As a first example, a pressing roller is pressed against a substantially tubular, metal heat conductor disposed inside a loop formed by the fixing belt to form a fixing nip between the pressing roller and the fixing belt. The metal heat conductor is supported by a support that divides the interior of the loop formed by the fixing belt into two compartments. The heater situated inside one of the two compartments heats the fixing belt via the metal heat conductor. As the fixing belt and the pressing roller rotate and convey a recording medium bearing a toner image through the fixing nip, the fixing belt and the pressing roller apply heat and pressure to the recording medium, thus fixing the toner image on the recording medium. Since the heater heats the fixing belt via the metal heat conductor that faces the entire inner circumferential surface of the fixing belt, the fixing belt is heated to a predetermined fixing temperature quickly, thus meeting the above-described requests of shortening the warm-up time and the first print time.

As a second example, the pressing roller is pressed against a nip formation pad disposed inside the loop formed by the fixing belt via the fixing belt to form the fixing nip between the pressing roller and the fixing belt. A reflector situated inside the loop formed by the fixing belt divides the interior of the loop formed by the fixing belt into two compartments: a first compartment accommodating the nip formation pad and a second compartment accommodating a heater. Thus, the heater is disposed opposite the nip formation pad via the reflector. Since the fixing belt is heated by both light radiated from the heater toward the fixing belt directly and light radiated from the heater and reflected by the reflector, the fixing belt is heated to a predetermined fixing temperature quickly, thus meeting the above-described requests of shortening the warm-up time and the first print time.

However, the support of the first example and the reflector of the second example that divide the interior of the loop formed by the fixing belt into the two compartments may obstruct uniform heating of the fixing belt in a circumferential direction thereof. For example, an opposed portion of the fixing belt disposed opposite the compartment accommodating the heater is heated by the heater directly. Conversely, a non-opposed portion of the fixing belt not accommodating the heater is not heated by the heater directly. Accordingly, before the fixing belt rotates for a substantial time, the temperature of the fixing belt may vary in the circumferential direction thereof between the opposed portion and the non-opposed portion. Such variation in the temperature of the fixing belt may lead to variation in thermal expansion of the fixing belt in the circumferential direction thereof, which may result in deformation, such as bending, warp, and buckling, of the fixing belt. Accordingly, the deformed fixing belt may produce the deformed fixing nip where the fixing belt and the pressing roller may not apply heat and pressure to the recording medium bearing the toner image uniformly, resulting in faulty fixing of the toner image on the recording medium.

SUMMARY OF THE INVENTION

This specification describes below an improved fixing device. In one exemplary embodiment of the present invention, the fixing device includes a hollow, fixing rotary body rotatable in a predetermined direction of rotation and a pressing rotary body pressingly contacting an outer circumferential surface of the fixing rotary body to form a fixing nip therebetween through which a recording medium bearing a toner image is conveyed. A partition is disposed inside the fixing rotary body to divide an interior of the fixing rotary body into a first compartment facing a heating span of the fixing rotary body spanning in a circumferential direction thereof and a second compartment facing a non-heating span of the fixing rotary body adjacent to the heating span. A heater is disposed opposite and heats the heating span of the fixing rotary body. A power supply is connected to the heater to supply power to the heater. A driver is connected to the fixing rotary body to rotate the fixing rotary body. A controller is operatively connected to the power supply and the driver to control the power supply and the driver. The controller performs at least one of a rotation speed control that controls the driver to rotate the fixing rotary body at an increased rotation speed and a power supply control that controls the power supply to supply an increased amount of power to the heater to decrease temperature differential between a temperature of the heating span of the fixing rotary body and a temperature of the non-heating span of the fixing rotary body.

This specification further describes an improved image forming apparatus. In one exemplary embodiment of the present invention, the image forming apparatus includes the fixing device described above.

This specification further describes an improved fixing method performed by a fixing device including a hollow, fixing rotary body and a partition dividing an interior of the fixing rotary body into a first compartment accommodating a heater and a second compartment. In one exemplary embodiment of the present invention, the fixing method includes the steps of powering on the fixing device; rotating the fixing rotary body at a first rotation speed; supplying power to the heater; determining whether or not a predetermined time has elapsed after starting rotation of the fixing rotary body at the first rotation speed; and rotating the fixing rotary body at a second rotation speed smaller than the first rotation speed after the predetermined time has elapsed.

This specification further describes an improved fixing method performed by a fixing device including a hollow, fixing rotary body and a partition dividing an interior of the fixing rotary body into a first compartment accommodating a heater and a second compartment. In one exemplary embodiment of the present invention, the fixing method includes the steps of powering on the fixing device; supplying a first amount of power to the heater; rotating the fixing rotary body by half period of rotation; and supplying a second amount of power greater than the first amount of power to the heater.

BRIEF DESCRIPTION OF THE SEVERAL VIEWS OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
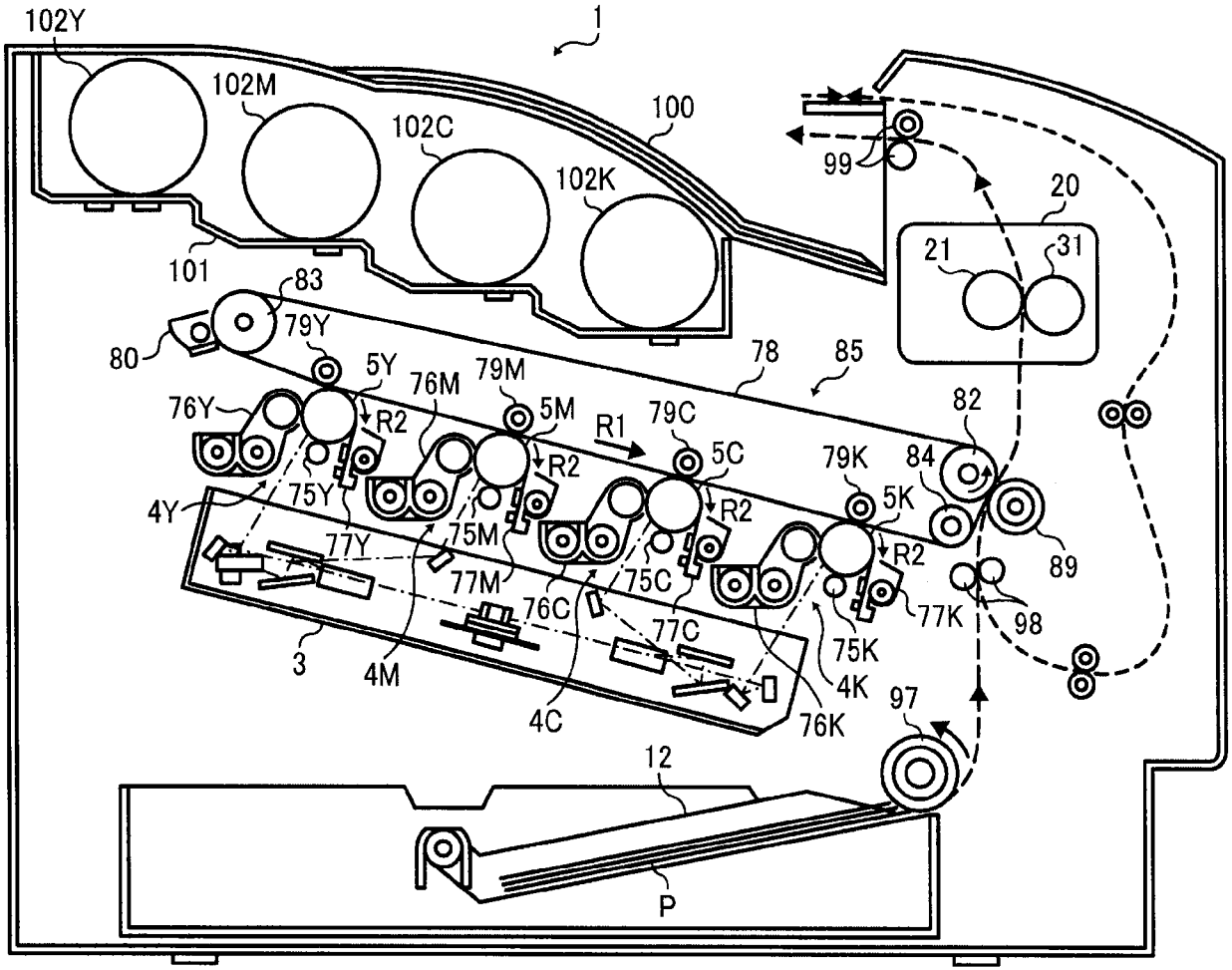
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic vertical sectional view of the image forming apparatus 1. The image forming apparatus 1 may be a copier, a facsimile machine, a printer, a multifunction printer (MFP) having at least one of copying, printing, scanning, plotter, and facsimile functions, or the like. According to this exemplary embodiment, the image forming apparatus 1 is a tandem color printer that forms color and monochrome toner images on recording media P by electrophotography.

Four toner bottles 102Y, 102M, 102C, and 102K containing fresh yellow, magenta, cyan, and black toners are detachably attached to a bottle holder 101 disposed in an upper portion of the image forming apparatus 1 so that the toner bottles 102Y, 102M, 102C, and 102K are replaceable with new ones, respectively. Below the bottle holder 101 is an intermediate transfer unit 85 including an intermediate transfer belt 78 rotatable in a rotation direction R1. The intermediate transfer belt 78 is disposed opposite four image forming devices 4Y, 4M, 4C, and 4K, aligned along the rotation direction R1 of the intermediate transfer belt 78, that form yellow, magenta, cyan, and black toner images, respectively.

The image forming devices 4Y, 4M, 4C, and 4K include photoconductive drums 5Y, 5M, 5C, and 5K, respectively. The photoconductive drums 5Y, 5M, 5C, and 5K are surrounded by chargers 75Y, 75M, 75C, and 75K, development devices 76Y, 76M, 76C, and 76K, cleaners 77Y, 77M, 77C, and 77K, and dischargers, respectively. The image forming devices 4Y, 4M, 4C, and 4K perform image forming processes including a charging process, an exposure process, a development process, a primary transfer process, and a cleaning process on the photoconductive drums 5Y, 5M, 5C, and 5K as the photoconductive drums 5Y, 5M, 5C, and 5K rotate clockwise in FIG. 1 in a rotation direction R2, thus forming yellow, magenta, cyan, and black toner images on the photoconductive drums 5Y, 5M, 5C, and 5K, respectively.

A detailed description is now given of the image forming processes performed on the photoconductive drums 5Y, 5M, 5C, and 5K.

A driver (e.g., a motor) drives and rotates the photoconductive drums 5Y, 5M, 5C, and 5K clockwise in FIG. 1 in the rotation direction R2. The chargers 75Y, 75M, 75C, and 75K uniformly charge an outer circumferential surface of the respective photoconductive drums 5Y, 5M, 5C, and 5K in the charging process. In the exposure process, an exposure device 3 emits laser beams onto the charged outer circumferential surface of the respective photoconductive drums 5Y, 5M, 5C, and 5K, forming electrostatic latent images thereon according to yellow, magenta, cyan, and black image data of color image data sent from an external device such as a client computer.

In the development process, the development devices 76Y, 76M, 76C, and 76K visualize the electrostatic latent images formed on the photoconductive drums 5Y, 5M, 5C, and 5K with yellow, magenta, cyan, and black toners supplied from the toner bottles 102Y, 102M, 102C, and 102K into yellow, magenta, cyan, and black toner images, respectively. The photoconductive drums 5Y, 5M, 5C, and 5K are disposed opposite primary transfer bias rollers 79Y, 79M, 79C, and 79K via the intermediate transfer belt 78 to form primary transfer nips between the intermediate transfer belt 78 and the photoconductive drums 5Y, 5M, 5C, and 5K, respectively. In the primary transfer process, the primary transfer bias rollers 79Y, 79M, 79C, and 79K transfer the yellow, magenta, cyan, and black toner images formed on the photoconductive drums 5Y, 5M, 5C, and 5K onto the intermediate transfer belt 78. After the primary transfer process, a slight amount of residual toner failed to be transferred onto the intermediate transfer belt 78 remains on the photoconductive drums 5Y, 5M, 5C, and 5K.

To address this circumstance, in the cleaning process, a cleaning blade of the respective cleaners 77Y, 77M, 77C, and 77K mechanically collects the residual toner from the photoconductive drums 5Y, 5M, 5C, and 5K. Finally, the dischargers remove residual potential from the photoconductive drums 5Y, 5M, 5C, and 5K. Thus, a series of image forming processes performed on the photoconductive drums 5Y, 5M, 5C, and 5K is completed.

The yellow, magenta, cyan, and black toner images transferred from the photoconductive drums 5Y, 5M, 5C, and 5K onto the intermediate transfer belt 78 are superimposed on a same position on the intermediate transfer belt 78. Thus, a color toner image is formed on the intermediate transfer belt 78.

A detailed description is now given of a construction of the intermediate transfer unit 85.

The intermediate transfer unit 85 includes the intermediate transfer belt 78, the four primary transfer bias rollers 79Y, 79M, 79C, and 79K, a secondary transfer backup roller 82, a cleaning backup roller 83, a tension roller 84, and an intermediate transfer belt cleaner 80. The intermediate transfer belt 78 is stretched across and supported by the three rollers, that is, the secondary transfer backup roller 82, the cleaning backup roller 83, and the tension roller 84. As the secondary transfer backup roller 82 is driven and rotated by a driver (e.g., a motor), the secondary transfer backup roller 82 drives and rotates the intermediate transfer belt 78 counterclockwise in FIG. 1 in the rotation direction R1 by friction therebetween.

The four primary transfer bias rollers 79Y, 79M, 79C, and 79K and the photoconductive drums 5Y, 5M, 5C, and 5K sandwich the intermediate transfer belt 78 to form the primary transfer nips between the photoconductive drums 5Y, 5M, 5C, and 5K and the intermediate transfer belt 78. A transfer bias having a polarity opposite a polarity of toner is applied to the primary transfer bias rollers 79Y, 79M, 79C, and 79K. As the intermediate transfer belt 78 rotating in the rotation direction R1 moves through the primary transfer nips, the primary transfer bias rollers 79Y, 79M, 79C, and 79K primarily transfer the yellow, magenta, cyan, and black toner images formed on the photoconductive drums 5Y, 5M, 5C, and 5K onto the intermediate transfer belt 78 in such a manner that the yellow, magenta, cyan, and black toner images are superimposed on the same position on the intermediate transfer belt 78, thus forming a color toner image thereon.

A detailed description is now given of a secondary transfer process performed on the intermediate transfer belt 78.

The secondary transfer backup roller 82 is disposed opposite a secondary transfer roller 89 via the intermediate transfer belt 78 to form a secondary transfer nip between the intermediate transfer belt 78 and the secondary transfer roller 89. As the color toner image formed on the intermediate transfer belt 78 moves through the secondary transfer nip, the secondary transfer roller 89 secondarily transfers the color toner image formed on the intermediate transfer belt 78 onto a recording medium P conveyed through the secondary transfer nip in the secondary transfer process. After the secondary transfer process, residual toner failed to be transferred onto the recording medium P remains on the intermediate transfer belt 78. To address this circumstance, as the residual toner remaining on the intermediate transfer belt 78 moves under the intermediate transfer belt cleaner 80, the intermediate transfer belt cleaner 80 collects the residual toner from the intermediate transfer belt 78. Thus, the secondary transfer process performed on the intermediate transfer belt 78 is completed.

A detailed description is now given of conveyance of the recording medium P.

The recording medium P is conveyed from a paper tray 12 located in a lower portion of the image forming apparatus 1 to the secondary transfer nip through a feed roller 97 and a registration roller pair 98 (e.g., a timing roller pair). For example, the paper tray 12 loads a plurality of layered recording media P (e.g., transfer sheets). As the feed roller 97 is driven and rotated counterclockwise in FIG. 1, an uppermost recording medium P is conveyed to a roller nip formed between two rollers of the registration roller pair 98.

As the recording medium P comes into contact with the registration roller pair 98, the registration roller pair 98 that stops its rotation halts the recording medium P temporarily. At a time when the color toner image formed on the intermediate transfer belt 78 reaches the secondary transfer nip, the registration roller pair 98 resumes its rotation to feed the recording medium P to the secondary transfer nip. As the recording medium P travels through the secondary transfer nip, the color toner image formed on the intermediate transfer belt 78 is secondarily transferred onto the recording medium P.

Thereafter, the recording medium P bearing the color toner image is conveyed to a fixing device 20. As the recording medium P is conveyed between a fixing belt 21 and a pressing roller 31 of the fixing device 20, the fixing belt 21 and the pressing roller 31 apply heat and pressure to the recording medium P, fixing the color toner image on the recording medium P. After the recording medium P bearing the fixed color toner image is discharged from the fixing device 20, the recording medium P is discharged to an outside of the image forming apparatus 1 through an output roller pair 99. The recording medium P discharged by the output roller pair 99 is stacked on an output tray 100 disposed atop the image forming apparatus 1. Thus, a series of image forming processes performed by the image forming apparatus 1 is completed.

With reference to FIGS. 2 to 5, a description is provided of a configuration of the fixing device 20 according to a first exemplary embodiment that is incorporated in the image forming apparatus 1 described above.

Figure 2:
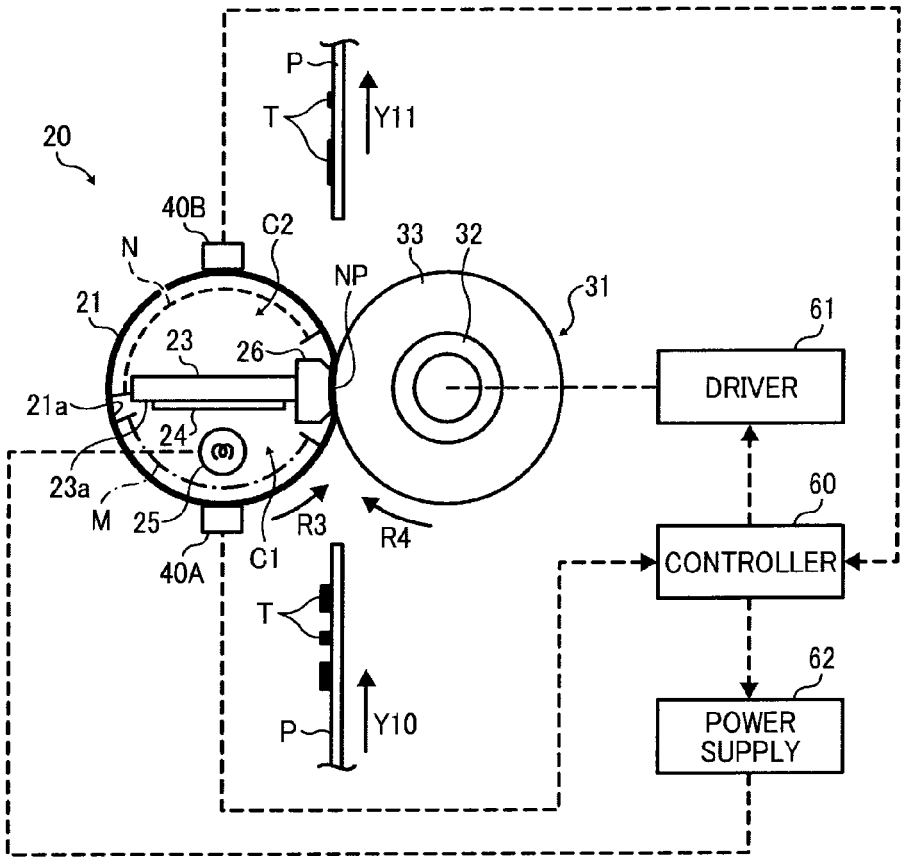
FIG. 2 is a vertical sectional view of a fixing device according to a first exemplary embodiment of the present invention that is incorporated in the image forming apparatus shown in FIG. 1.
Figure 3:
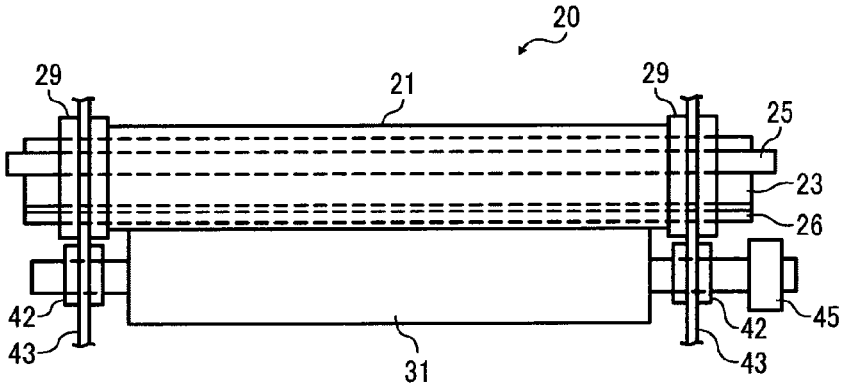
FIG. 3 is a horizontal sectional view of the fixing device shown in FIG. 2.
Figure 4:
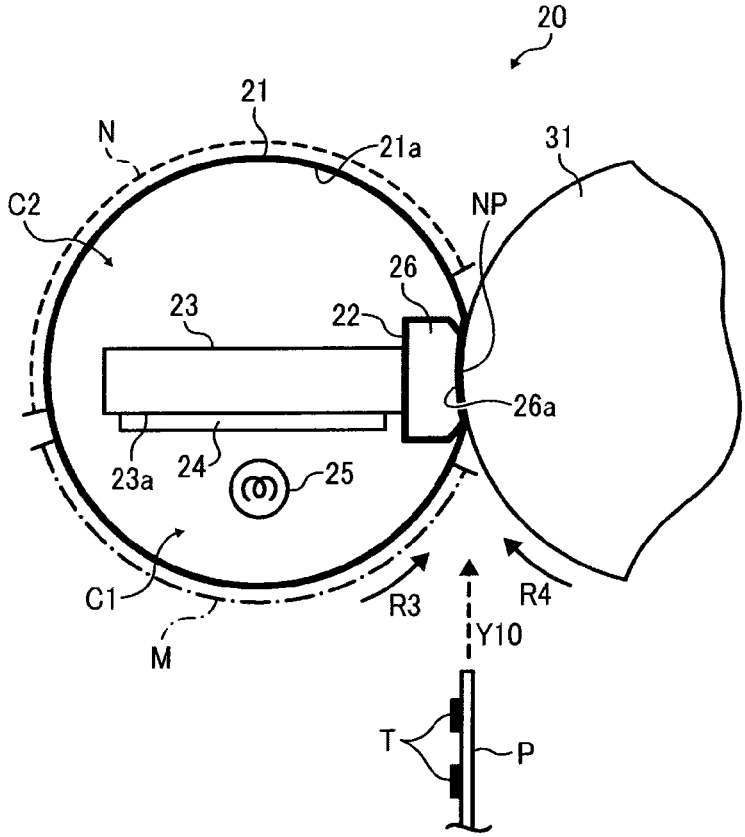
FIG. 4 is a partial vertical sectional view of the fixing device shown in FIG. 2.
Figure 5:
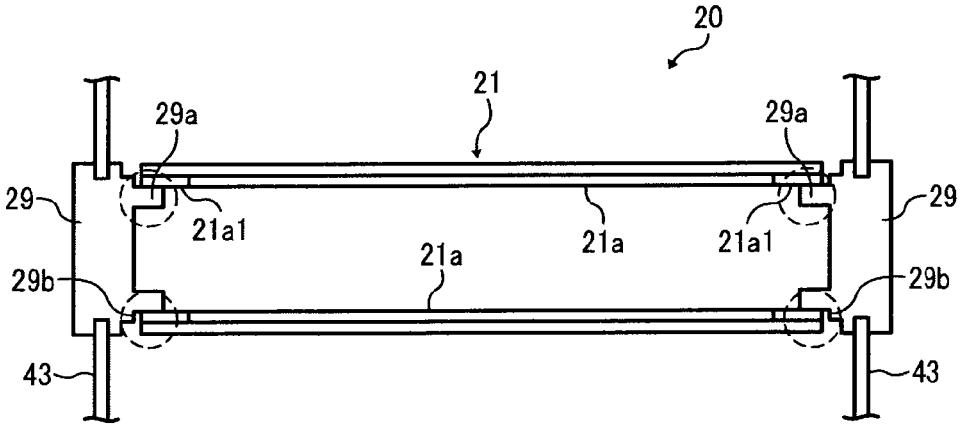
FIG. 5 is a partial horizontal sectional view of the fixing device shown in FIG. 3 illustrating a fixing belt incorporated therein.

FIG. 2 is a vertical sectional view of the fixing device 20. FIG. 3 is a horizontal sectional view of the fixing device 20. FIG. 4 is a partial vertical sectional view of the fixing device 20. FIG. 5 is a partial horizontal sectional view of the fixing device 20 illustrating the fixing belt 21.

As shown in FIG. 2, the fixing device 20 (e.g., a fuser) includes the fixing belt 21 serving as a fixing rotary body formed into a loop and rotatable in a rotation direction R3; a nip formation pad 26 disposed inside the loop formed by the fixing belt 21; a support 23 disposed inside the loop formed by the fixing belt 21 to contact and support the nip formation pad 26; a heater 25 disposed inside the loop formed by the fixing belt 21 to heat the fixing belt 21; the pressing roller 31 serving as a pressing rotary body pressed against the nip formation pad 26 via the fixing belt 21 to form a fixing nip NP between the pressing roller 31 and the fixing belt 21 and rotatable in a rotation direction R4 counter to the rotation direction R3 of the fixing belt 21; a first temperature sensor 40A and a second temperature sensor 40B disposed opposite an outer circumferential surface of the fixing belt 21 to detect the temperature of the fixing belt 21; and a reflector 24 attached to the support 23 to reflect light radiated from the heater 25 toward the fixing belt 21.

A detailed description is now given of a construction of the fixing belt 21.

The fixing belt 21 is a thin, flexible endless belt rotatable counterclockwise in FIG. 2 in the rotation direction R3. The fixing belt 21, having a thickness of about 1 mm or smaller, is constructed of a base layer constituting an inner circumferential surface 21*a* that slides over the nip formation pad 26; an elastic layer coating the base layer; and a surface release layer coating the elastic layer. The base layer, having a thickness in a range of from about 30 micrometers to about 50 micrometers, is made of metal such as nickel and stainless steel or resin such as polyimide. The elastic layer, having a thickness in a range of from about 100 micrometers to about 300 micrometers, is made of rubber such as silicone rubber, silicone rubber foam, and fluoro rubber. The elastic layer absorbs slight surface asperities of the fixing belt 21 at the fixing nip NP when the pressing roller 31 is pressed against the nip formation pad 26 via the fixing belt 21, facilitating even conduction of heat from the fixing belt 21 to a toner image T on a recording medium P passing through the fixing nip NP and thereby minimizing formation of an orange peel image. The release layer, having a thickness in a range of from about 5 micrometers to about 50 micrometers, is made of tetrafluoroethylene-perfluoroalkylvinylether copolymer (PFA), polytetrafluoroethylene (PTFE), polyimide, polyether imide, polyether sulfone (PES), or the like. The release layer facilitates separation of the toner image T on the recording medium P from the fixing belt 21. According to this exemplary embodiment, in normal image forming operation, the rotation speed of the fixing belt 21 and the pressing roller 31 is controlled such that the fixing belt 21 travels through the fixing nip NP at a linear velocity of about 50 mm/s.

A loop diameter of the fixing belt 21 is in a range of from about 15 mm to about 120 mm. According to this exemplary embodiment, an inner loop diameter of the fixing belt 21 is about 30 mm. As shown in FIG. 4, inside the loop formed by the fixing belt 21 are the nip formation pad 26, the heater 25, the support 23, the reflector 24, and a low friction sheet 22 surrounding the nip formation pad 26 that are stationarily disposed opposite the inner circumferential surface 21 a of the fixing belt 21. For example, the inner circumferential surface 21 a of the fixing belt 21 slides over the stationary nip formation pad 26. The nip formation pad 26 presses against the pressing roller 31 via the fixing belt 21 to form the fixing nip NP between the fixing belt 21 and the pressing roller 31 through which the recording medium P bearing the toner image T is conveyed. As shown in FIG. 3, both lateral ends of the nip formation pad 26 in a longitudinal direction thereof parallel to an axial direction of the fixing belt 21 and a width direction of the recording medium P are supported by flanges 29, serving as a holder, mounted on side plates 43 of the fixing device 20, respectively. A detailed description of a configuration of the nip formation pad 26 and the flange 29 is deferred. The fixing belt 21 is heated directly by light, that is, heat, radiated from the heater 25 situated inside the loop formed by the fixing belt 21.

A detailed description is now given of a configuration of the heater 25.

As shown in FIG. 3, the heater 25 (e.g., a halogen heater or a carbon heater) is situated inside the loop formed by the fixing belt 21. Both lateral ends of the heater 25 in a longitudinal direction thereof parallel to the axial direction of the fixing belt 21 are mounted on the side plates 43 of the fixing device 20, respectively. As shown in FIG. 2, the heater 25, interposed between the support 23 and the fixing belt 21 in a diametrical direction of the fixing belt 21, is disposed opposite a heating span M of the inner circumferential surface 21*a* of the fixing belt 21 that spans in a circumferential direction of the fixing belt 21 to heat the fixing belt 21 over the heating span M directly by radiation heat.

A controller 60, that is, a processor, is a central processing unit (CPU) provided with a random-access memory (RAM) and a read-only memory (ROM), for example. The controller 60 is operatively connected to a power supply 62 connected to the heater 25, thus controlling the heater 25. As the fixing belt 21 rotates and conveys the recording medium P through the fixing nip NP, heat is conducted from the fixing belt 21 heated by the heater 25 to the recording medium P. The first temperature sensor 40A and the second temperature sensor 40B (e.g., thermistors) serve as a first temperature detector and a second temperature detector, respectively, disposed opposite the outer circumferential surface of the fixing belt 21. The controller 60, operatively connected to the first temperature sensor 40A, the second temperature sensor 40B, and the heater 25 through the power supply 62, controls the heater 25 based on the temperature of the outer circumferential surface of the fixing belt 21 detected by the first temperature sensor 40A and the second temperature sensor 40B, mainly by the first temperature sensor 40A. Thus, the controller 60 controls the heater 25 to heat the fixing belt 21 to a desired fixing temperature. According to this exemplary embodiment, the single heater 25 is situated inside the loop formed by the fixing belt 21. Alternatively, a plurality of heaters may be situated inside the loop formed by the fixing belt 21.

The heater 25 having the configuration described above heats the fixing belt 21 over a relatively great span of the fixing belt 21 in the circumferential direction thereof, not at the fixing nip NP only. Accordingly, the heater 25 heats the fixing belt 21 sufficiently, minimizing faulty fixing that may arise due to a decreased temperature of the fixing belt 21 lower than the fixing temperature. That is, the fixing device 20 heats the fixing belt 21 efficiently with the relatively simple, downsized structure of the fixing device 20, shortening a warm-up time to warm up the fixing belt 21 and a first print time taken to output the recording medium P bearing the toner image T onto the outside of the image forming apparatus 1 after the image forming apparatus 1 receives a print job. The heater 25 heats the fixing belt 21 directly, improving heating efficiency of heating the fixing belt 21 with the downsized fixing device 20 manufactured at reduced costs.

A detailed description is now given of a configuration of the flanges 29.

As shown in FIG. 5, the two flanges 29, made of heat-resistant resin, engage the side plates 43 situated at both lateral ends of the fixing device 20 in a longitudinal direction thereof, respectively. Each flange 29 is constructed of a guide 29*a* and a stopper 29*b*. The guide 29*a* contacts the inner circumferential surface 21*a* of the fixing belt 21 to support and guide the fixing belt 21 rotating in the rotation direction R3 while retaining a substantially circular loop of the fixing belt 21. The stopper 29*b* is disposed opposite a lateral edge of the fixing belt 21 in the axial direction thereof. If the fixing belt 21 is skewed in the axial direction thereof, it comes into contact with the stopper 29*b* of the flange 29. Thus, the stopper 29*b* regulates movement or skew of the fixing belt 21 in the axial direction thereof. Optionally, a slip ring separately provided from the flange 29 may be interposed between the stopper 29*b* and the lateral edge of the fixing belt 21 in the axial direction thereof. The slip ring may be made of a heat-resistant, low frictional material such as polyether ether ketone (PEEK), polyphenylene sulfide (PPS), polyamide imide (PAI), and PTFE, to reduce wear of the lateral edge of the fixing belt 21 in the axial direction thereof that may be caused by friction between the fixing belt 21 and the flange 29.

Since the flanges 29 contact and support both lateral ends of the fixing belt 21 in the axial direction thereof, respectively, the flanges 29 retain the circular loop of the fixing belt 21 at both lateral ends of the fixing belt 21 in the axial direction thereof. However, as the fixing belt 21 rotates in the rotation direction R3, a center of the fixing belt 21 in the axial direction thereof may warp depending on its rigidity and thereby may come into contact with the components disposed in proximity to the fixing belt 21 such as the support 23 and the reflector 24 depicted in FIG. 4. To address this circumstance, if the fixing belt 21 has a relatively great rigidity, the fixing belt 21 may be spaced apart from the proximity components with an interval of about 0.02 mm or more therebetween. Conversely, if the fixing belt 21 has a relatively small rigidity, the fixing belt 21 may be spaced apart from the proximity components with an interval of about 3.00 mm or more therebetween.

As shown in FIG. 5, the inner circumferential surface 21 a of the fixing belt 21 is coated with a low friction layer 21*a*1, at each lateral end of the fixing belt 21 in the axial direction thereof indicated by the broken line in FIG. 5, that slides over the guide 29*a* of the flange 29. The low friction layer 21*a*1 reduces frictional resistance between the guide 29*a* and the fixing belt 21 sliding thereover. For example, the low friction layer 21*a*1 is produced by coating a surface of the base layer of the fixing belt 21 with a low friction material such as fluoroplastic. Thus, even if the fixing belt 21 slides over the guide 29*a* of the flange 29 as the fixing belt 21 rotates in the rotation direction R3, the low friction layer 21*a*1 minimizes wear of the fixing belt 21 and the guide 29*a* of the flange 29 caused by friction therebetween.

Since the inner circumferential surface 21*a* of the fixing belt 21 is contacted by the flanges 29 situated at both lateral ends of the fixing belt 21 in the axial direction thereof and the nip formation pad 26 only, no other component is in contact with the inner circumferential surface 21*a* of the fixing belt 21 to guide the fixing belt 21 rotating in the rotation direction R3. That is, the fixing device 20 according to this exemplary embodiment eliminates a tubular metal heat conductor disposed opposite substantially the entire inner circumferential surface 21*a* of the fixing belt 21. Instead of the metal heat conductor, the fixing device 20 employs the heater 25 that heats the fixing belt 21 directly to improve heating efficiency of heating the fixing belt 21 with the downsized fixing device 20 manufactured at reduced costs. For example, the fixing belt 21 is supported by the flanges 29 that contact the inner circumferential surface 21 a of the fixing belt 21.

A detailed description is now given of a configuration of the support 23.

As shown in FIG. 4, the support 23 is stationarily situated inside the loop formed by the fixing belt 21 to support the nip formation pad 26 against pressure from the pressing roller 31. As shown in FIG. 3, a length of the support 23 in a longitudinal direction thereof parallel to the axial direction of the fixing belt 21 is equivalent to a length of the nip formation pad 26 in the longitudinal direction thereof. Both lateral ends of the support 23 in the longitudinal direction thereof are mounted on the flanges 29, respectively. Specifically, the support 23 is sandwiched between the flange 29 and the nip formation pad 26 at each lateral end of the support 23 in the longitudinal direction thereof, thus being positioned relative to the nip formation pad 26. A distal end of the support 23 opposite a proximal end thereof that contacts the nip formation pad 26 is in contact with a holding portion produced on a part of an inner circumferential face of each flange 29 to hold the support 23. Alternatively, instead of the holding portion of each flange 29, the side plates 43 may contact and hold the support 23. The support 23 presses against the pressing roller 31 via the nip formation pad 26 and the fixing belt 21, supporting the nip formation pad 26 against pressure from the pressing roller 31 at the fixing nip NP and thereby protecting the nip formation pad 26 from deformation by pressure from the pressing roller 31.

As shown in FIG. 4, the support 23 is a substantially planar plate serving as a partition that divides the interior of the loop formed by the fixing belt 21 into two compartments, that is, an upstream, first compartment C1 disposed upstream from the fixing nip NP and a downstream, second compartment C2 disposed downstream from the fixing nip NP in the rotation direction R3 of the fixing belt 21. The support 23 is made of metal having a relatively great mechanical strength such as stainless steel and iron that achieves the advantages of the support 23 described above to support the nip formation pad 26. A description of the configuration of the support 23 in more detail is deferred.

As shown in FIG. 4, the reflector 24 (e.g., a reflection plate) is mounted on an opposed face 23*a* of the support 23 disposed opposite the heater 25. Accordingly, the reflector 24 reflects light radiated from the heater 25 toward the support 23, that is, heat to be conducted to the support 23, toward the fixing belt 21 to heat the fixing belt 21, improving heating efficiency of heating the fixing belt 21. For example, the reflector 24 is made of aluminum or stainless steel. Alternatively, the opposed face 23*a* of the support 23 may be mirror finished or coated with a heat insulator partially or entirely to achieve the advantages of the reflector 24 described above.

A detailed description is now given of a construction of the pressing roller 31.

As shown in FIG. 2, the pressing roller 31 serves as a pressing rotary body to contact the outer circumferential surface of the fixing belt 21 at the fixing nip NP. The pressing roller 31 having a diameter of about 30 mm is constructed of a hollow metal core 32 and an elastic layer 33 coating the metal core 32. The elastic layer 33 is made of silicone rubber foam, silicone rubber, fluoro rubber, or the like. Optionally, a thin, surface release layer made of PFA, PTFE, or the like may coat the elastic layer 33. The pressing roller 31 is pressed against the nip formation pad 26 via the fixing belt 21 to form the desired fixing nip NP between the pressing roller 31 and the fixing belt 21. As shown in FIG. 3, the pressing roller 31 is attached with a gear 45 engaging a gear train connected to a driver 61 (e.g., a motor) depicted in FIG. 2 that drives and rotates the pressing roller 31 clockwise in FIG. 2 in the rotation direction R4. As shown in FIG. 3, both lateral ends of the pressing roller 31 in an axial direction thereof are rotatably supported by the side plates 43 through bearings 42, respectively. Optionally, a heater such as a halogen heater may be disposed inside the pressing roller 31. According to this exemplary embodiment, the driver 61 for driving and rotating the pressing roller 31 is a variable speed motor that changes the rotation speed of the pressing roller 31 and the fixing belt 21, a detailed description of which is deferred.

If the elastic layer 33 of the pressing roller 31 is made of sponge such as silicone rubber foam, the pressing roller 31 exerts reduced pressure to the nip formation pad 26 at the fixing nip NP, reducing load imposed on the nip formation pad 26. Additionally, the elastic layer 33 enhances insulation of the pressing roller 31, depressing conduction of heat from the fixing belt 21 to the pressing roller 31 and thereby improving heating efficiency of heating the fixing belt 21. According to this exemplary embodiment, the loop diameter of the fixing belt 21 is equivalent to the diameter of the pressing roller 31. Alternatively, the loop diameter of the fixing belt 21 may be smaller than the diameter of the pressing roller 31. In this case, the curvature of the fixing belt 21 at the fixing nip NP is greater than that of the pressing roller 31, facilitating separation of the recording medium P discharged from the fixing nip NP from the fixing belt 21.

A detailed description is now given of a configuration of the nip formation pad 26.

As shown in FIG. 4, the nip formation pad 26 over which the inner circumferential surface 21*a* of the fixing belt 21 slides has a slide face 26*a* disposed opposite the pressing roller 31 via the fixing belt 21. The slide face 26*a* is curved or concave with respect to the pressing roller 31 in accordance with the curvature of the pressing roller 31, that is, a curve of the pressing roller 31 at the fixing nip NP. Accordingly, the curved slide face 26*a* directs the recording medium P discharged from the fixing nip NP along the curve of the pressing roller 31, facilitating separation of the recording medium P bearing the fixed toner image T from the fixing belt 21 and preventing the recording medium P from adhering to the fixing belt 21. According to this exemplary embodiment, the slide face 26*a* of the nip formation pad 26 disposed opposite the pressing roller 31 at the fixing nip NP is concave with respect to the pressing roller 31.

Alternatively, the slide face 26*a* of the nip formation pad 26 may be planar to produce the planar fixing nip NP substantially parallel to an imaged side of the recording medium P that bears the toner image T. The planar fixing nip NP shapes the fixing belt 21 into a plane at the fixing nip NP, bringing the fixing belt 21 into intimate contact with the recording medium P passing through the fixing nip NP and thereby improving fixing performance. Additionally, the planar fixing nip NP increases the curvature of the fixing belt 21 at an exit of the fixing nip NP, facilitating separation of the recording medium P discharged from the fixing nip NP from the fixing belt 21.

The nip formation pad 26 is made of resin, metal, or the like. For example, the nip formation pad 26 is made of heat-resistant, insulative resin that has a regidity great enough to endure pressure from the pressing roller 31 and prevent substantial bending of the nip formation pad 26, such as liquid crystal polymer (LCP), PAI, PES, PPS, polyethernitrile (PEN), and PEEK. According to this exemplary embodiment, the nip formation pad 26 is made of LCP.

The nip formation pad 26 is partially or entirely covered with the low friction sheet 22 made of a low friction material such as PTFE to reduce frictional resistance between the nip formation pad 26 and the fixing belt 21 sliding thereover. For example, the low friction sheet 22 extends throughout the entire width of the nip formation pad 26 in the axial direction of the fixing belt 21 and surrounds the nip formation pad 26 in cross-section in FIG. 4 so that the low friction sheet 22 is sandwiched between the nip formation pad 26 and the fixing belt 21 at the fixing nip NP. According to this exemplary embodiment, the low friction sheet 22 is made of fiber impregnated with a lubricant such as silicone oil, for example, cloth made of fluoroplastic such as PTFE. Accordingly, the lubricant impregnated in the low friction sheet 22 is retained between the slide face 26*a* of the nip formation pad 26 and the inner circumferential surface 21*a* of the fixing belt 21. Consequently, the lubricant reduces wear of the nip formation pad 26 and the fixing belt 21 caused by friction therebetween as the fixing belt 21 slides over the nip formation pad 26.

With reference to FIGS. 1 and 2, a description is provided of a fixing operation of the fixing device 20 having the configuration described above to fix a toner image T on a recording medium P.

As a power switch of the image forming apparatus 1 is turned on, the controller 60 controls the power supply 62 to supply power to the heater 25. Simultaneously, the controller 60 actuates the driver 61 to drive and rotate the pressing roller 31 in the rotation direction R4. Accordingly, the fixing belt 21 rotates in the rotation direction R3 in accordance with rotation of the pressing roller 31 by friction therebetween at the fixing nip NP. Alternatively, the driver 61 may be connected to the fixing belt 21 to drive and rotate it or connected to both the pressing roller 31 and the fixing belt 21 to drive and rotate them. Thereafter, as a recording medium P conveyed from the paper tray 12 reaches the secondary transfer nip, the secondary transfer roller 89 transfers a toner image T formed on the intermediate transfer belt 78 onto the recording medium P. The recording medium P bearing the toner image T is conveyed in a recording medium conveyance direction Y10 while guided by a guide plate and enters the fixing nip NP formed between the fixing belt 21 and the pressing roller 31 pressed against each other. As the recording medium P is conveyed through the fixing nip NP, the recording medium P receives heat from the fixing belt 21 heated by the heater 25 and pressure from the pressing roller 31 and the fixing belt 21 pressed against the pressing roller 31 by the nip formation pad 26 supported by the support 23. Thus, the toner image T is fixed on the recording medium P by the heat and pressure. Thereafter, the recording medium P bearing the fixed toner image T is discharged from the fixing nip NP and conveyed in a recording medium conveyance direction Y11.

A description is provided of a detailed configuration of the fixing device 20.

As shown in FIG. 4, the heater 25 situated in the first compartment C1 is disposed opposite a part of the inner circumferential surface 21 a of the fixing belt 21 in the circumferential direction thereof. That is, the heater 25 heats the heating span M of the fixing belt 21 spanning in the circumferential direction thereof directly by radiation heat, that is, light of infrared radiation. Since the fixing belt 21 is rotatable in the rotation direction R3, a portion of the fixing belt 21 corresponding to the heating span M changes as the fixing belt 21 rotates. For example, the support 23, attached with the reflector 24 and situated at substantially a center of the space inside the loop formed by the fixing belt 21, divides the interior of the loop formed by the fixing belt 21 into the two compartments, that is, the first compartment C1 and the second compartment C2. The heater 25 is located in the lower, upstream first compartment C1 disposed upstream from the fixing nip NP in the rotation direction R3 of the fixing belt 21. Hence, the support 23 allows the heater 25 to directly heat the heating span M of the fixing belt 21 facing the first compartment C1. Contrarily, the support 23 prohibits the heater 25 from heating a non-heating span N of the fixing belt 21 directly. The non-heating span N facing the second compartment C2 defines a span of the fixing belt 21 in the circumferential direction other than the heating span M. Accordingly, immediately after the fixing belt 21 starts its rotation, the temperature of the fixing belt 21 varies in the circumferential direction thereof Specifically, a portion of the fixing belt 21 passing through the heating span M is heated to a temperature higher than a temperature of another portion of the fixing belt 21 passing though the non-heating span N.

To address this circumstance, according to this exemplary embodiment, the controller 60 depicted in FIG. 2 performs a control method (hereinafter referred to as a temperature differential minimization control method) that decreases the temperature differential between the temperature of a heated portion of the fixing belt 21 disposed opposite the heating span M of the fixing belt 21 and the temperature of a non-heated portion of the fixing belt 21 disposed opposite the non-heating span N of the fixing belt 21 that are created before the fixing belt 21 starts its rotation. The temperature differential minimization control method is performed while the fixing belt 21 rotates before a recording medium P enters the fixing nip NP. The controller 60 performs the temperature differential minimization control method to address the circumstance that occurs when the controller 60 turns on the power supply 62 to warm up the fixing belt 21 or when the controller 60 controls the heater 25 to heat the fixing belt 21 to a predetermined fixing temperature from an energy saver mode, that is, a standby mode in which power supply to the heater 25 is interrupted or a decreased amount of power is supplied to the heater 25. For example, immediately after power is supplied to the heater 25, the heater 25 heats the heated portion of the fixing belt 21 corresponding to the heating span M. Conversely, since heat radiated from the heater 25 is blocked by the support 23, the heater 25 does not heat the non-heated portion of the fixing belt 21 corresponding to the non-heating span N sufficiently.

This problem may occur even if the controller 60 is configured to supply power to the heater 25 when a predetermined time elapses after the fixing belt 21 starts its rotation. This problem may also occur even if the fixing belt 21 is configured to be heated by the heater 25 while the fixing belt 21 rotates for a substantial time before a recording medium P enters the fixing nip NP. For example, when the fixing belt 21 is warmed up in a cool environment, heat moves from the fixing belt 21 heated by the heater 25 to the pressing roller 31 having a greater thermal capacity. Hence, even if the fixing belt 21 is rotated for the substantial time, variation in the temperature of the fixing belt 21 is not eliminated. This problem is noticeable in a fixing device in which the fixing belt 21 is configured to have a construction that facilitates quick heating of the fixing belt 21 because the heated portion of the fixing belt 21 disposed opposite the heating span M is heated by the heater 25 quickly before the fixing belt 21 starts its rotation. Further, this problem is also noticeable in a fixing device in which the fixing belt 21 is configured to rotate at a relatively low speed because the heated portion of the fixing belt 21 disposed opposite the heating span M is heated by the heater 25 longer.

To address this problem, according to this exemplary embodiment, the controller 60 performs the temperature differential minimization control method while no recording medium P is conveyed through the fixing nip NP, for example, when the controller 60 turns on the power supply 62 to warm up the fixing belt 21 or when the controller 60 controls the heater 25 to heat the fixing belt 21 to the predetermined fixing temperature from the energy saver mode. Mainly, the controller 60 performs the temperature differential minimization control method to warm up the fixing belt 21. For example, the driver 61 for driving and rotating the pressing roller 31 is a variable speed motor separately provided from other drivers (e.g., motors) that drive and rotate the components of the image forming apparatus 1 other than the pressing roller 31. The driver 61 serves as a speed adjuster that adjusts the rotation speed of the fixing belt 21.

A description is provided of the temperature differential minimization control method.

Figure 6:
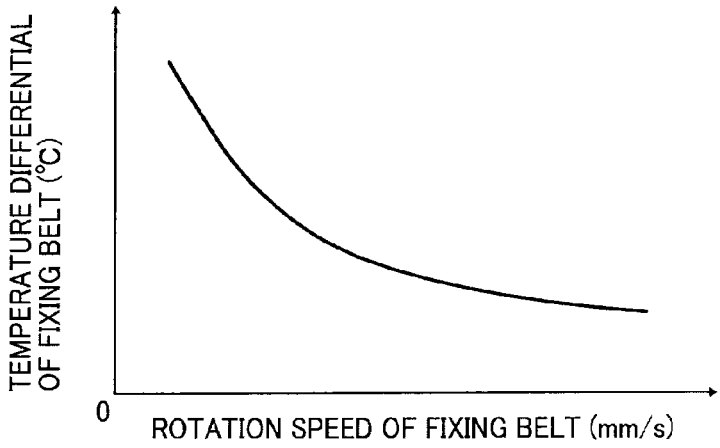
FIG. 6 is a graph showing a relation between the rotation speed of the fixing belt shown in FIG. 5 and the temperature differential of the fixing belt in a circumferential direction thereof.

For example, the controller 60 controls the driver 61 to increase the rotation speed of the fixing belt 21 when the temperature differential between the temperature of the heated portion of the fixing belt 21 corresponding to the heating span M and the temperature of the non-heated portion of the fixing belt 21 corresponding to the non-heating span N is relatively great. It is because as the rotation speed of the fixing belt 21 increases, the heated portion of the fixing belt 21 corresponding to the heating span M and the non-heated portion of the fixing belt 21 corresponding to the non-heating span N change places quickly, decreasing variation in the temperature of the fixing belt 21 in the circumferential direction thereof that may arise immediately after the fixing belt 21 starts its rotation, as shown in FIG. 6. FIG. 6 is a graph showing a relation between the rotation speed of the fixing belt 21 and the temperature differential of the fixing belt 21 in the circumferential direction thereof. As shown in FIG. 6, as the rotation speed of the fixing belt 21 increases, variation in the temperature of the fixing belt 21 in the circumferential direction thereof decreases.

A detailed description is now given of a first example of the temperature differential minimization control method that adjusts the rotation speed of the fixing belt 21.

Specifically, when the controller 60 turns on the power supply 62 to warm up the fixing belt 21 or when the controller 60 controls the heater 25 to heat the fixing belt 21 to the predetermined fixing temperature from the energy saver mode, the controller 60 controls the driver 61 to increase the rotation speed of the fixing belt 21 to an increased rotation speed of about 100 mm/s greater than a normal rotation speed of about 50 mm/s until a predetermined time elapses after the fixing belt 21 starts its rotation.

Figure 7:
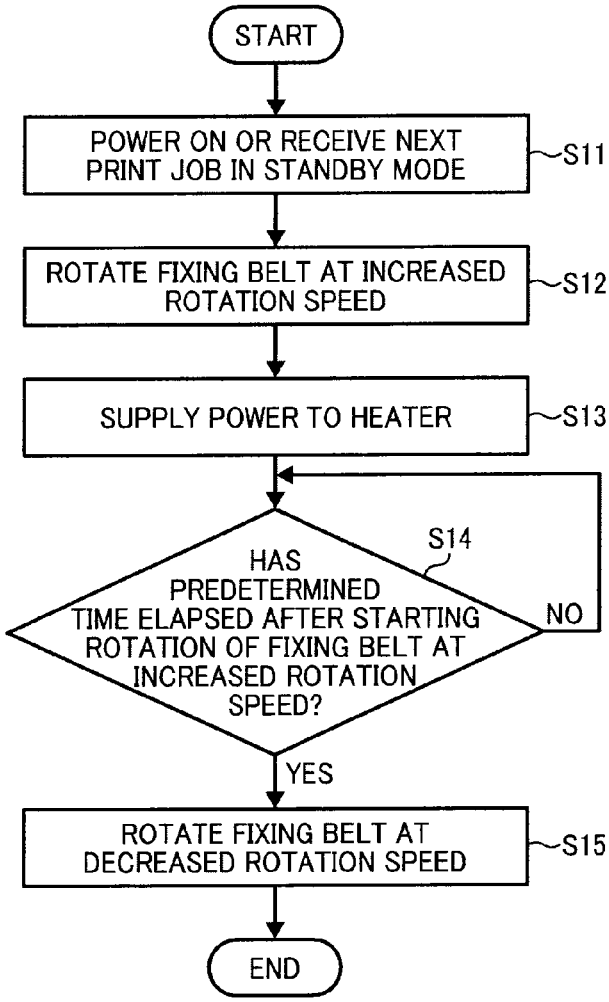
FIG. 7 is a flowchart illustrating processes of a first example of a temperature differential minimization control method performed by the fixing device shown in FIG. 2.

FIG. 7 is a flowchart illustrating processes of the first example of the temperature differential minimization control method, that is, an example of a rotation speed control method that adjusts the rotation speed of the fixing belt 21.

As shown in FIG. 7, in step S11, the image forming apparatus 1 as well as the fixing device 20 is powered on or receives a next print job in the standby mode. In step S12, the controller 60 controls the driver 61 to rotate the fixing belt 21 at an increased rotation speed of about 100 mm/s. In step S13, the controller 60 controls the power supply 62 to supply power to the heater 25. In step S14, the controller 60 determines whether or not a predetermined time has elapsed after starting rotation of the fixing belt 21 at the increased rotation speed. If the controller 60 determines that the predetermined time has elapsed after starting rotation of the fixing belt 21 at the increased rotation speed (YES in step S14), the controller 60 controls the driver 61 to rotate the fixing belt 21 at a decreased rotation speed of about 50 mm/s in step S15.

Figure 8:
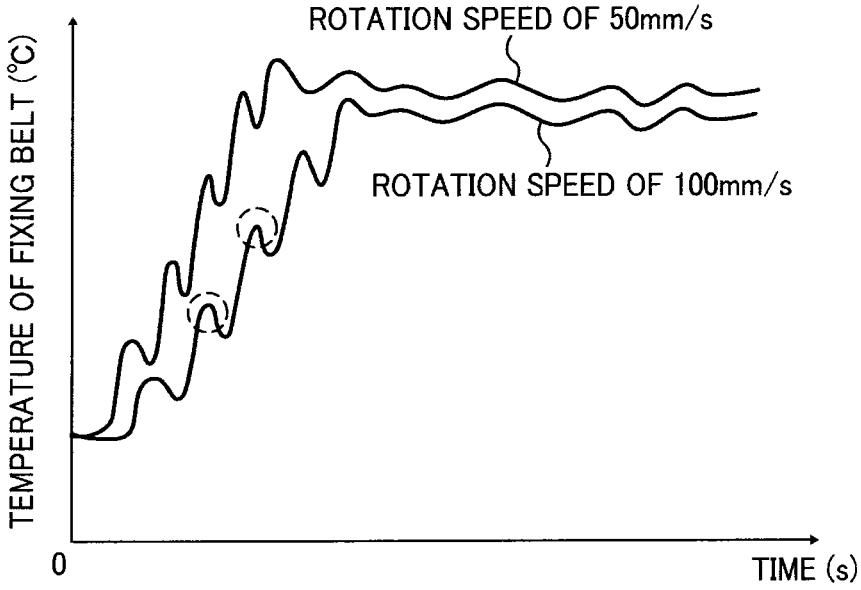
FIG. 8 is a graph showing a relation between time and the temperature of the fixing belt shown in FIG. 5 when the fixing belt rotates at the rotation speeds of 50 mm/s and 100 mm/s.

However, although the first example of the temperature differential minimization control method reduces variation in the temperature of the fixing belt 21 in the circumferential direction thereof, it is necessary to heat the pressing roller 31 that has a thermal capacity greater than that of the fixing belt 21. That is, it is necessary to supply a greater amount of heat to the pressing roller 31 than the fixing belt 21, taking longer to warm up the fixing device 20 as shown in FIG. 8. FIG. 8 is a graph showing a relation between time and the temperature of the fixing belt 21 when the fixing belt 21 rotates at the rotation speeds of 50 mm/s and 100 mm/s. As shown in FIG. 8, when the fixing belt 21 rotates at the rotation speed of 100 mm/s, it takes longer before the temperature of the fixing belt 21 is saturated and therefore warm-up of the fixing belt 21 is completed.

To address this circumstance, the controller 60 may perform the temperature differential minimization control method based on the temperature differential between the temperature of the heating span M of the fixing belt 21 and the temperature of the non-heating span N of the fixing belt 21. As shown in FIG. 2, the temperature of the heating span M of the fixing belt 21 is detected by the first temperature sensor 40A serving as a first temperature detector; the temperature of the non-heating span N of the fixing belt 21 is detected by the second temperature sensor 40B serving as a second temperature detector. The second temperature sensor 40B is spaced apart from the first temperature sensor 40A by about 180 degrees in the circumferential direction of the fixing belt 21.

A detailed description is now given of a second example of the temperature differential minimization control method that adjusts the rotation speed of the fixing belt 21 based on the temperatures detected by the first temperature sensor 40A and the second temperature sensor 40B.

Specifically, immediately after the controller 60 turns on the power supply 62 to warm up the fixing belt 21 or immediately after the controller 60 controls the heater 25 to heat the fixing belt 21 to the predetermined fixing temperature from the energy saver mode, the controller 60 detects the temperature differential between the temperature of the heating span M of the fixing belt 21 detected by the first temperature sensor 40A and the temperature of the non-heating span N of the fixing belt 21 detected by the second temperature sensor 40B. If the controller 60 determines that the temperature differential exceeds a predetermined value, for example, about 100 degrees centigrade, the controller 60 controls the driver 61 to increase the rotation speed of the fixing belt 21 to the increased rotation speed greater than the normal rotation speed until the predetermined time elapses after the fixing belt 21 starts its rotation.

Figure 9:
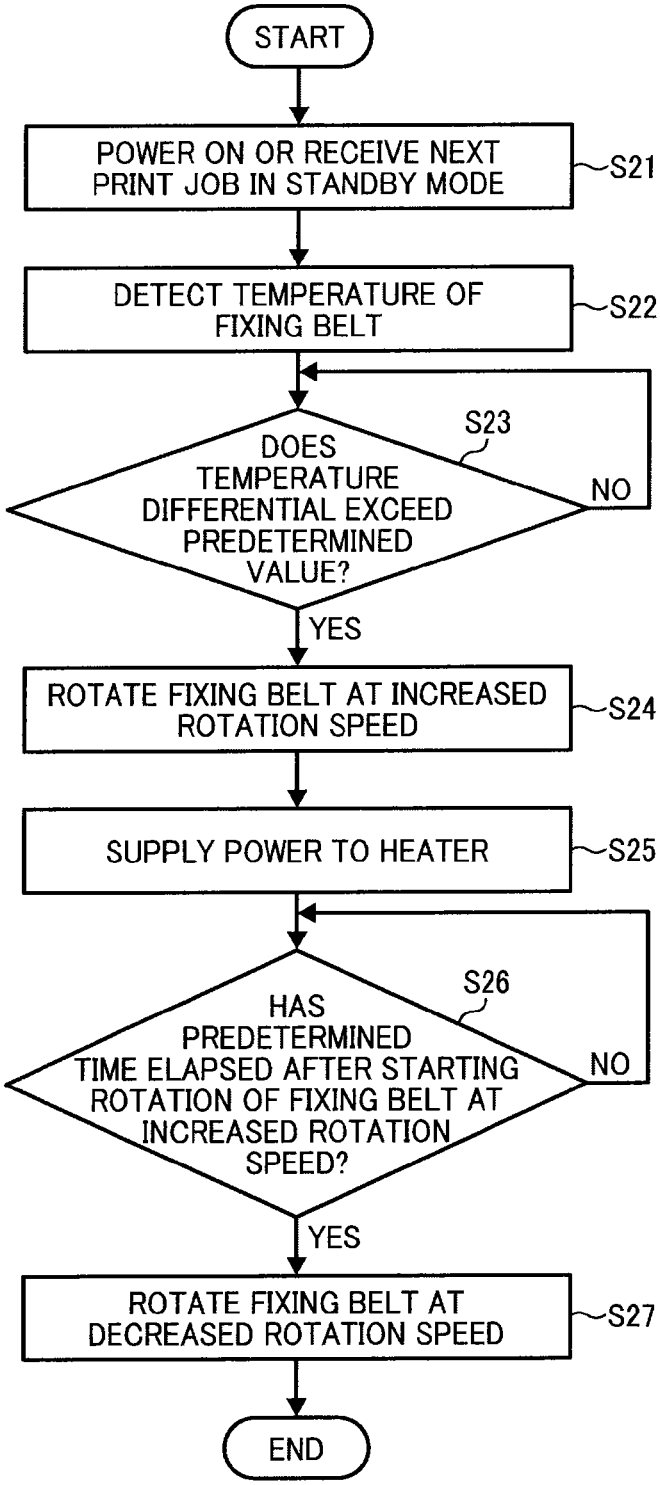
FIG. 9 is a flowchart illustrating processes of a second example of the temperature differential minimization control method.

FIG. 9 is a flowchart illustrating processes of the second example of the temperature differential minimization control method, that is, a variation of the rotation speed control method that adjusts the rotation speed of the fixing belt 21 based on the temperatures detected by the first temperature sensor 40A and the second temperature sensor 40B.

As shown in FIG. 9, in step S21, the image forming apparatus 1 as well as the fixing device 20 is powered on or receives a next print job in the standby mode. In step S22, the first temperature sensor 40A detects the temperature of the heating span M of the fixing belt 21 and the second temperature sensor 40B detects the temperature of the non-heating span N of the fixing belt 21. In step S23, the controller 60 determines whether or not the temperature differential between the temperature detected by the first temperature sensor 40A and the temperature detected by the second temperature sensor 40B exceeds a predetermined value of about 100 degrees centigrade. If the controller 60 determines that the temperature differential exceeds the predetermined value (YES in step S23), the controller 60 controls the driver 61 to rotate the fixing belt 21 at the increased rotation speed of about 100 mm/s in step S24. In step S25, the controller 60 controls the power supply 62 to supply power to the heater 25. In step S26, the controller 60 determines whether or not the predetermined time has elapsed after starting rotation of the fixing belt 21 at the increased rotation speed. If the controller 60 determines that the predetermined time has elapsed (YES in step S26), the controller 60 controls the driver 61 to rotate the fixing belt 21 at the decreased rotation speed of about 50 mm/s in step S27.

Accordingly, unlike the first example of the temperature differential minimization control method in which the controller 60 always rotates the fixing belt 21 at the increased rotation speed for the predetermined time upon warm-up of the fixing belt 21, in the second example of the temperature differential minimization control method, the controller 60 rotates the fixing belt 21 at the increased rotation speed only when the temperature differential of the fixing belt 21 between the temperatures detected by the first temperature sensor 40A and the second temperature sensor 40B exceeds the predetermined value, thus minimizing the warm-up time for warming up the fixing belt 21. The temperature differential of the fixing belt 21, that is, a threshold based on which the controller 60 determines whether or not to perform the second example of the temperature differential minimization control method, is defined based on whether or not the temperature differential is great enough to bend or warp the fixing belt 21 substantially, that is, to a degree that causes buckling of the fixing belt 21. For example, variation in the temperature of the fixing belt 21 in the circumferential direction thereof causes variation in thermal expansion of the fixing belt 21 in the circumferential direction thereof that may bend or warp the fixing belt 21. If bending or warp of the fixing belt 21 exceeds yield stress of the fixing belt 21, buckling or breakage of the fixing belt 21 may occur.

Figure 10:
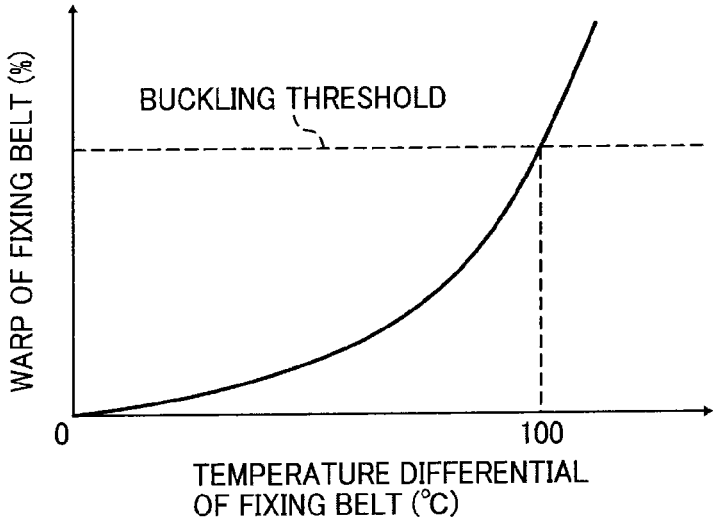
FIG. 10 is a graph showing a relation between the temperature differential of the fixing belt shown in FIG. 5 in the circumferential direction thereof and warp or bending of a surface of the fixing belt.

With reference to FIG. 10, a detailed description is now given of buckling of the fixing belt 21.

FIG. 10 is a graph showing a relation between the temperature differential of the fixing belt 21 in the circumferential direction thereof and warp or bending of the surface of the fixing belt 21. As shown in FIG. 10, as the temperature differential of the fixing belt 21 increases, an amount of warp or bending of the fixing belt 21 including the base layer made of SUS stainless steel increases. As the temperature differential of the fixing belt 21 reaches 100 degrees centigrade, warp or bending of the fixing belt 21 reaches the buckling threshold. To address this circumstance, the controller 60 performs the second example of the temperature differential minimization control method only when the temperature differential of the fixing belt 21 immediately before rotating the fixing belt 21 exceeds 100 degrees centigrade at or above which buckling of the fixing belt 21 occurs.

Bending or warp that leads to buckling, caused by the temperature differential of the fixing belt 21, appears at a center of the fixing belt 21 in the axial direction thereof. It is because, when the fixing belt 21 thermally expands both in the circumferential direction and the axial direction thereof as it is heated by the heater 25, thermal expansion of the fixing belt 21 in the circumferential direction thereof changes an outer loop diameter of the fixing belt 21 only but thermal expansion of the fixing belt 21 in the axial direction thereof varies depending on the position in the circumferential direction of the fixing belt 21. As a result, the fixing belt 21 thermally expands into an arc in the axial direction thereof.

As described above, the controller 60 performs the temperature differential minimization control method when the fixing belt 21 rotates in the rotation direction R3 while no recording medium P is conveyed through the fixing nip NP, minimizing the temperature differential between the temperature of the heated portion of the fixing belt 21 corresponding to the heating span M and the temperature of the non-heated portion of the fixing belt 21 corresponding to the non-heating span N that are created before the fixing belt 21 starts its rotation and thereby minimizing bending or warp of the fixing belt 21 that may arise due to variation in the temperature of the fixing belt 21 in the circumferential direction thereof. As shown in FIG. 4, since the heater 25 is situated in the lower, first compartment C1 inside the loop formed by the fixing belt 21 created by the support 23, hot air generated in the lower, first compartment C1 moves upward into the upper, second compartment C2, thus heating the non-heating span N of the fixing belt 21. Hence, the temperature differential between the temperature of the heated span M of the fixing belt 21 and the temperature of the non-heated span N of the fixing belt 21 is reduced. As described above, bending or warp of the fixing belt 21, which leads to buckling, caused by the temperature differential of the fixing belt 21 in the circumferential direction thereof appears at the center of the fixing belt 21 in the axial direction thereof. Accordingly, if the fixing device 20 is configured to incorporate a first heater for heating the center of the fixing belt 21 in the axial direction thereof and a second heater for heating each lateral end of the fixing belt 21 in the axial direction thereof, the first heater is situated in the lower, first compartment C1 and the second heater is situated in the upper, second compartment C2 to reduce bending and warp of the fixing belt 21 effectively.

In the first example and the second example of the temperature differential minimization control method described above, the controller 60 changes the rotation speed of the fixing belt 21 by using the driver 61 serving as a speed adjuster. Alternatively, the controller 60 may change an amount of heat radiated from the heater 25 by using the power supply 62 serving as a heat radiation adjuster in a third example of the temperature differential minimization control method described below.

A detailed description is now given of the third example of the temperature differential minimization control method.

The controller 60 controls the power supply 62 to change an amount of power or a lighting duty supplied to the heater 25. For example, the controller 60 controls the power supply 62 to increase the amount of power supplied to the heater 25 when the non-heated portion of the fixing belt 21 corresponding to the non-heating span N moves to the heating span M of the fixing belt 21 as the fixing belt 21 rotates in the rotation direction R3. Specifically, in synchronism with half period of rotation of the fixing belt 21, when the cool, non-heated portion of the fixing belt 21 corresponding to the non-heating span N reaches the heating span M of the fixing belt 21 disposed opposite the heater 25, the controller 60 controls the power supply 62 to increase the amount of power supplied to the heater 25, thus increasing an amount of radiation heat from the heater 25. Conversely, when the warm, heated portion of the fixing belt 21 already heated by the heater 25 returns and reaches the heating span M disposed opposite the heater 25, the controller 60 controls the power supply 62 to decrease the amount of power supplied to the heater 25, thus decreasing the amount of radiation heat from the heater 25.

Figure 11:
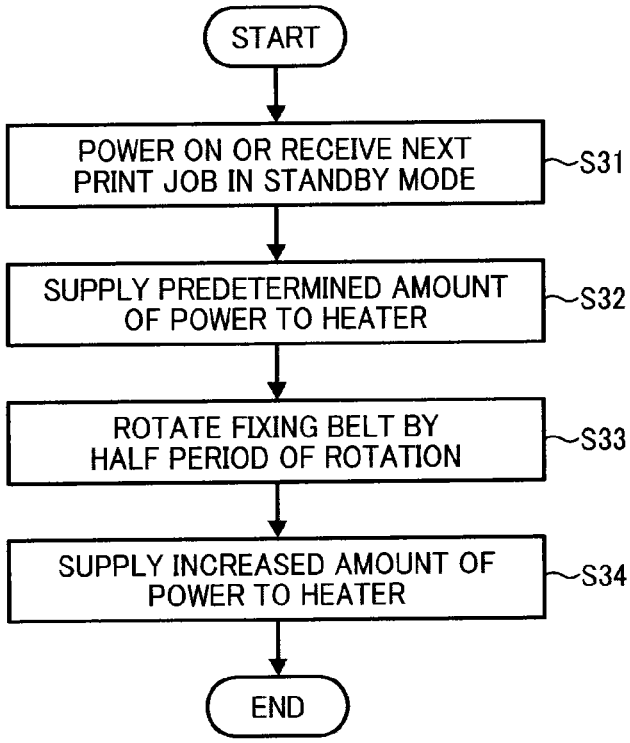
FIG. 11 is a flowchart illustrating processes of a third example of the temperature differential minimization control method.

FIG. 11 is a flowchart illustrating processes of the third example of the temperature differential minimization control method, that is, an example of a power supply control method that changes the amount of power supplied to the heater 25.

As shown in FIG. 11, in step S31, the image forming apparatus 1 as well as the fixing device 20 is powered on or receives a next print job in the standby mode. In step S32, the controller 60 controls the power supply 62 to supply a predetermined amount of power to the heater 25. In step S33, the controller 60 controls the driver 61 to rotate the fixing belt 21 by half period of rotation. In step S34, the controller 60 controls the power supply 62 to supply an increased amount of power, that is greater than the predetermined amount of power supplied in step S32, to the heater 25.

Hence, the temperature differential of the fixing belt 21 in the circumferential direction thereof is minimized. By employing the third example of the temperature differential minimization control method, it is not necessary to control the driver 61 independently from other motor. Additionally, it does not take longer to warm up the fixing belt 21.

Alternatively, instead of changing the amount of power supplied to the heater 25 every half period of rotation of the fixing belt 21, the controller 60 may change the amount of power supplied to the heater 25 by adjusting the period of change based on the temperature of the fixing belt 21 detected by the first temperature sensor 40A and the second temperature sensor 40B.

Yet alternatively, like in the second example of the temperature differential minimization control method described above, the controller 60 may perform the third example of the temperature differential minimization control method only when the temperature differential between the temperatures of the fixing belt 21 detected by the first temperature sensor 40A and the second temperature sensor 40B exceeds the predetermined value.

Figure 12:
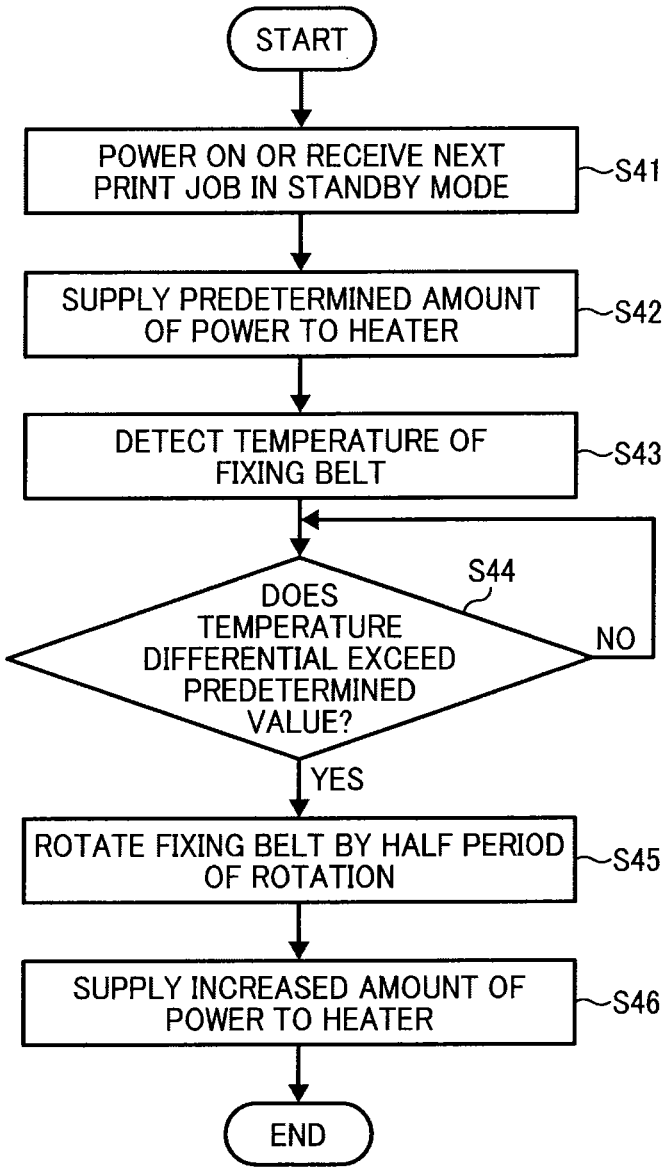
FIG. 12 is a flowchart illustrating processes of a first variation of the third example of the temperature differential minimization control method.

FIG. 12 is a flowchart illustrating processes of a first variation of the third example of the temperature differential minimization control method, that is, a first variation of the power supply control method that changes the amount of power supplied to the heater 25 by adjusting the period of change based on the temperature of the fixing belt 21 detected by the first temperature sensor 40A and the second temperature sensor 40B.

As shown in FIG. 12, in step S41, the image forming apparatus 1 as well as the fixing device 20 is powered on or receives a next print job in the standby mode. In step S42, the controller 60 controls the power supply 62 to supply the predetermined amount of power to the heater 25. In step S43, the first temperature sensor 40A detects the temperature of the heating span M of the fixing belt 21 and the second temperature sensor 40B detects the temperature of the non-heating span N of the fixing belt 21. In step S44, the controller 60 determines whether or not the temperature differential between the temperature detected by the first temperature sensor 40A and the temperature detected by the second temperature sensor 40B exceeds a predetermined value of about 100 degrees centigrade. If the controller 60 determines that the temperature differential exceeds the predetermined value (YES in step S44), the controller 60 controls the driver 61 to rotate the fixing belt 21 by half period of rotation in step S45. In step S46, the controller 60 controls the power supply 62 to supply the increased amount of power, that is greater than the predetermined amount of power supplied in step S42, to the heater 25.

Figure 13:
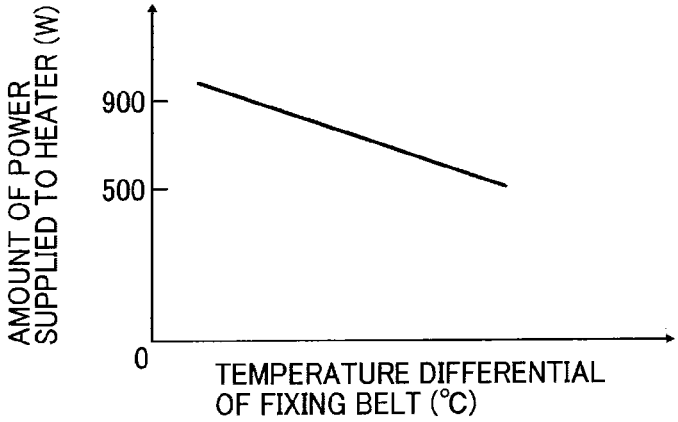
FIG. 13 is a graph showing a relation between the temperature differential of the fixing belt shown in FIG. 5 in the circumferential direction thereof and the amount of power supplied to a heater incorporated in the fixing device shown in FIG. 2.

Yet alternatively, the controller 60 controls the power supply 62 to supply an increased amount of power to the heater 25 during warm-up of the fixing belt 21 because the increased amount of power supplied to the heater 25 decreases the temperature differential of the fixing belt 21 in the circumferential direction thereof as shown in FIG. 13 illustrating an experiment result. FIG. 13 is a graph showing a relation between the temperature differential of the fixing belt 21 in the circumferential direction thereof and the amount of power supplied to the heater 25. As shown in FIG. 13, as the amount of power supplied to the heater 25 increases, the temperature differential of the fixing belt 21 in the circumferential direction thereof decreases.

Figure 14:
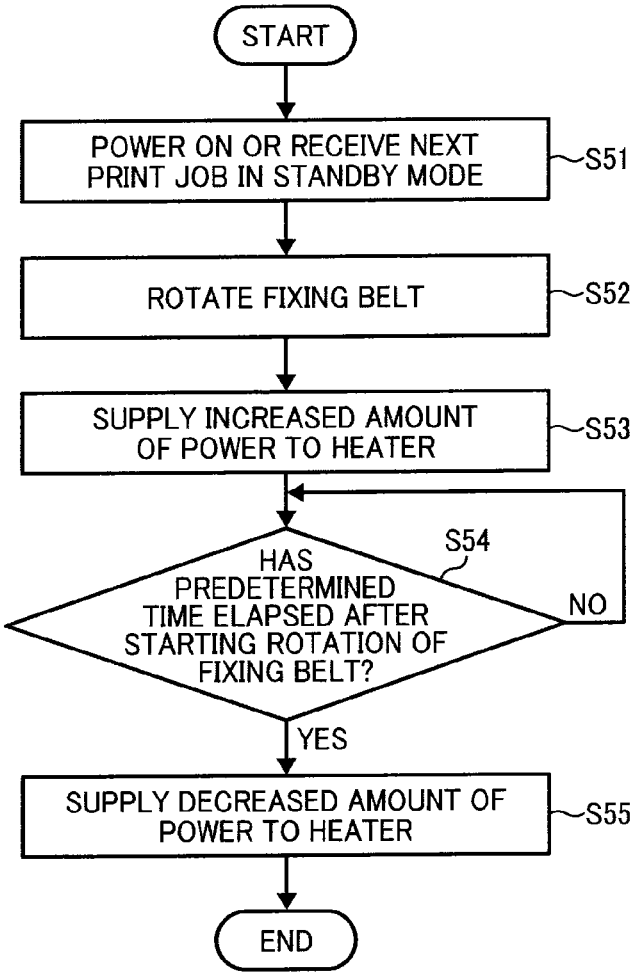
FIG. 14 is a flowchart illustrating processes of a second variation of the third example of the temperature differential minimization control method.

FIG. 14 is a flowchart illustrating processes of a second variation of the third example of the temperature differential minimization control method, that is, a second variation of the power supply control method that supplies the increased amount of power to the heater 25 during warm-up of the fixing belt 21.

As shown in FIG. 14, in step S51, the image forming apparatus 1 as well as the fixing device 20 is powered on or receives a next print job in the standby mode. In step S52, the controller 60 controls the driver 61 to rotate the fixing belt 21. In step S53, the controller 60 controls the power supply 62 to supply the increased amount of power to the heater 25. In step S54, the controller 60 determines whether or not a predetermined time has elapsed after starting rotation of the fixing belt 21. If the controller 60 determines that the predetermined time has elapsed after starting rotation of the fixing belt 21 (YES in step S54), the controller 60 controls the power supply 62 to supply a decreased amount of power to the heater 25 in step S55.

Figure 15:
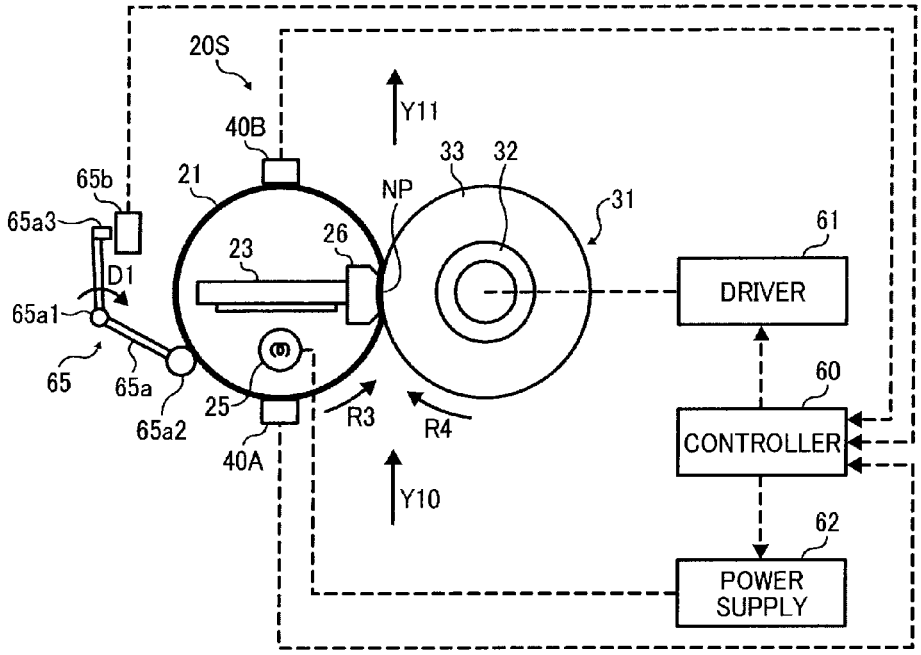
FIG. 15 is a vertical sectional view of a fixing device as a first variation of the fixing device shown in FIG. 2.
Figure 16:
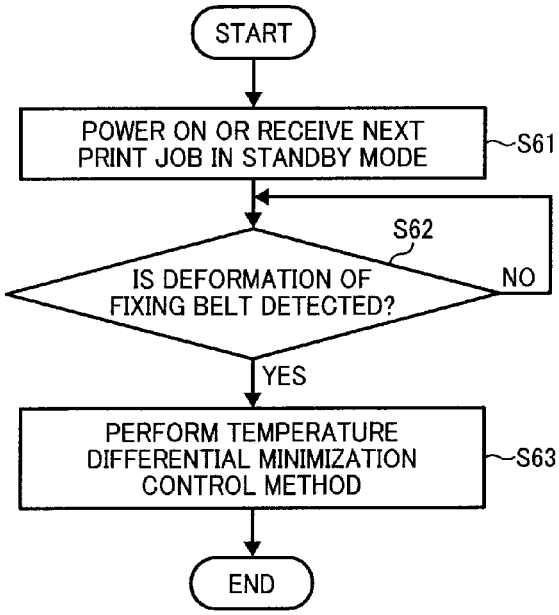
FIG. 16 is a flowchart illustrating processes of the temperature differential minimization control method performed by the fixing device shown in FIG. 15.
Figure 17:
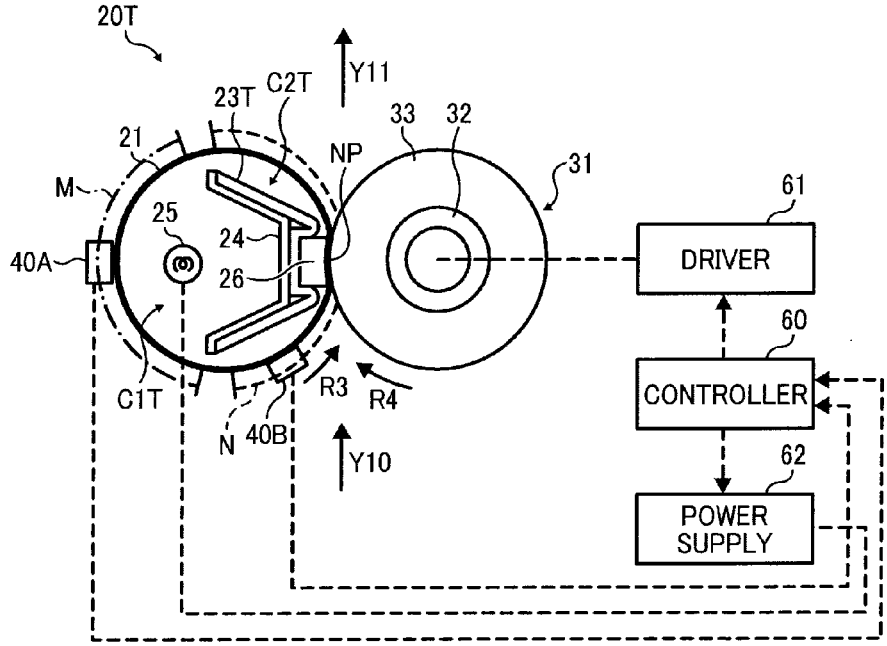
FIG. 17 is a vertical sectional view of a fixing device as a second variation of the fixing device shown in FIG. 2.

With reference to FIGS. 15 to 17, a description is provided of three variations of the fixing device 20 shown in FIG. 2 according to the first exemplary embodiment.

With reference to FIG. 15, a description is now given of a first variation of the fixing device 20 depicted in FIG. 2.

FIG. 15 is a vertical sectional view of a fixing device 20S as the first variation of the fixing device 20. As shown in FIG. 15, unlike the fixing device 20 depicted in FIG. 2, the fixing device 20S includes a deformation detector 65 that detects deformation (e.g., bending, warp, and buckling) of the fixing belt 21. If the deformation detector 65 detects deformation of the fixing belt 21, that is, a predetermined amount of deformation, the controller 60 performs at least one of the first to third examples of the temperature differential minimization control method and the variations thereof described above.

A detailed description is now given of a construction of the deformation detector 65.

As shown in FIG. 15, the deformation detector 65 is constructed of a lever 65*a*, a shaft 65*a*1, and a photo sensor 65*b*. The lever 65*a* is supported by the shaft 65*a*1 such that the lever 65*a* is pivotable about the shaft 65*a*1. A biasing member biases the lever 65*a* against the fixing belt 21 so that a first end 65*a*2 of the lever 65*a* movably contacts the outer circumferential surface of the fixing belt 21 at the center of the fixing belt 21 in the axial direction thereof. A second end 65*a*3 of the lever 65*a* is disposed in proximity to the photo sensor 65*b* operatively connected to the controller 60. If a substantial deformation of the fixing belt 21 that may nearly reach or exceed the buckling threshold appears at the center of the fixing belt 21 in the axial direction thereof, the deformed fixing belt 21 rotates the lever 65*a* in a pivoting direction D1, bringing the second end 65*a*3 of the lever 65*a* into contact with the photo sensor 65*b*. Thus, the photo sensor 65*b* detects deformation of the fixing belt 21. When the deformation detector 65 detects deformation of the fixing belt 21, the controller 60 controls the driver 61 and the power supply 62 to perform at least one of the first to third examples of the temperature differential minimization control method and the variations thereof described above. Thus, deformation of the fixing belt 21 caused by variation in the temperature of the fixing belt 21 is prevented precisely.

FIG. 16 is a flowchart illustrating processes of the temperature differential minimization control method performed by the fixing device 20S depicted in FIG. 15.

As shown in FIG. 16, in step S61, the image forming apparatus 1 as well as the fixing device 20S is powered on or receives a next print job in the standby mode. In step S62, the controller 60 determines whether or not deformation of the fixing belt 21 is detected by the deformation detector 65. If the controller 60 determines that deformation of the fixing belt 21 is detected (YES in step S62), the controller 60 performs the temperature differential minimization control method, that is, at least one of the rotation speed control methods and the power supply control methods shown in FIGS. 7, 9, 11, 12, and 14, in step S63.

With reference to FIG. 17, a description is provided of a second variation of the fixing device 20 depicted in FIG. 2.

FIG. 17 is a vertical sectional view of a fixing device 20T as the second variation of the fixing device 20. As shown in FIG. 17, unlike the fixing device 20 depicted in FIG. 2, the fixing device 20T includes a substantially W-shaped support 23T in cross-section instead of the straight support 23 depicted in FIG. 2. Hence, unlike the heater 25 of the fixing device 20 that is located in the lower, first compartment C1 created by the straight support 23, the heater 25 of the fixing device 20T is located at substantially a center inside the loop formed by the fixing belt 21 and disposed opposite an interior wall of the support 23T. The support 23T serves as a partition that divides the interior of the loop formed by the fixing belt 21 into two compartments, that is, a first compartment C1T accommodating the heater 25 and a second compartment C2T, producing the heating span M of the fixing belt 21 facing the first compartment C1T and the non-heating span N of the fixing belt 21 facing the second compartment C2T. The heating span M of the fixing belt 21 is disposed opposite the heater 25 directly and thereby heated by the heater 25 directly. Conversely, the non-heating span N of the fixing belt 21 is disposed opposite the heater 25 via the support 23T that blocks light radiated from the heater 25 and thereby not heated by the heater 25 directly.

To address this circumstance, like the fixing device 20 depicted in FIG. 2, the controller 60 of the fixing device 20T performs the temperature differential minimization control method that decreases the temperature differential between the temperature of the heated portion of the fixing belt 21 corresponding to the heating span M and the temperature of the non-heated portion of the fixing belt 21 corresponding to the non-heating span N that are created before the fixing belt 21 starts its rotation. The temperature differential minimization control method is performed while the fixing belt 21 rotates before a recording medium P enters the fixing nip NP. Thus, deformation of the fixing belt 21 caused by variation in the temperature of the fixing belt 21 in the circumferential direction thereof is minimized.

Figure 18:
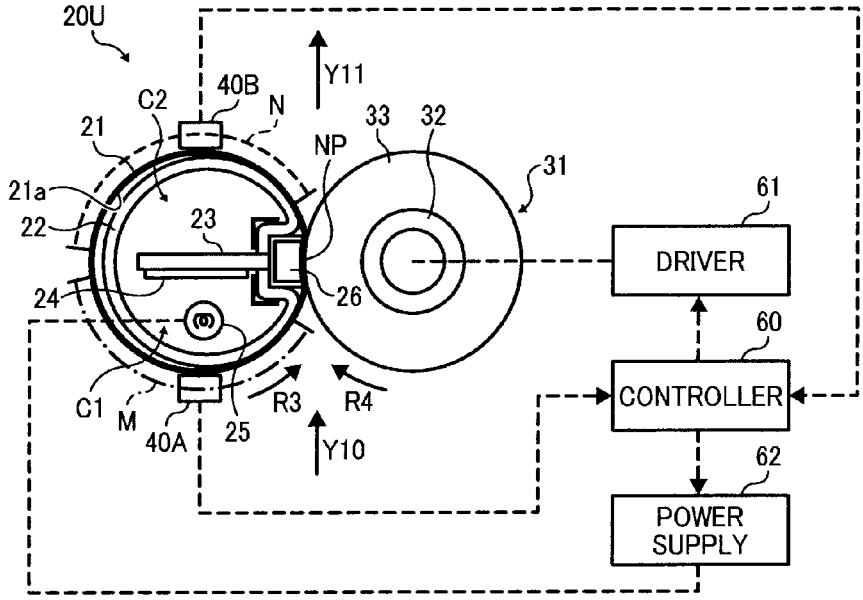
FIG. 18 is a vertical sectional view of a fixing device as a third variation of the fixing device shown in FIG. 2.

With reference to FIG. 18, a description is provided of a third variation of the fixing device 20 depicted in FIG. 2.

FIG. 18 is a vertical sectional view of a fixing device 20U as the third variation of the fixing device 20. As shown in FIG. 18, unlike the fixing device 20 depicted in FIG. 2, the fixing device 20U includes a substantially tubular, metal heat conductor 22 disposed opposite the inner circumferential surface 21*a* of the fixing belt 21 at a span other than the fixing nip NP in the circumferential direction of the fixing belt 21. As the heater 25 disposed inside a substantial loop formed by the metal heat conductor 22 heats the metal heat conductor 22, the metal heat conductor 22 in turn heats the fixing belt 21. That is, the heater 25 heats the fixing belt 21 indirectly via the metal heat conductor 22. The support 23 located inside the substantial loop formed by the metal heat conductor 22 produces the heating span M of the fixing belt 21 disposed opposite the heater 25 via the metal heat conductor 22 and heated by the heater 25 indirectly via the metal heat conductor 22 and the non-heating span N of the fixing belt 21 disposed opposite the heater 25 via the support 23 that blocks light radiated from the heater 25 and thereby not heated by the heater 25 via the metal heat conductor 22. To address this circumstance, like the fixing device 20 depicted in FIG. 2, the controller 60 of the fixing device 20U performs the temperature differential minimization control method that decreases the temperature differential between the temperature of the heated portion of the fixing belt 21 corresponding to the heating span M and the temperature of the non-heated portion of the fixing belt 21 corresponding to the non-heating span N that are created before the fixing belt 21 starts its rotation. The temperature differential minimization control method is performed while the fixing belt 21 rotates before a recording medium P enters the fixing nip NP. Thus, deformation of the fixing belt 21 caused by variation in the temperature of the fixing belt 21 in the circumferential direction thereof is minimized.

As described above, the fixing devices 20, 20S, 20T, and 20U, although incorporating the heater 25 disposed opposite a part of the inner circumferential surface 21 a of the fixing belt 21 in the circumferential direction thereof, employ the controller 60 that performs the temperature differential minimization control method that decreases the temperature differential between the temperature of the heated portion of the fixing belt 21 corresponding to the heating span M and the temperature of the non-heated portion of the fixing belt 21 corresponding to the non-heating span N that are created before the fixing belt 21 starts its rotation. The temperature differential minimization control method is performed while the fixing belt 21 rotates before a recording medium P enters the fixing nip NP. Thus, deformation of the fixing belt 21 caused by variation in the temperature of the fixing belt 21 in the circumferential direction thereof is minimized.

Figure 19:
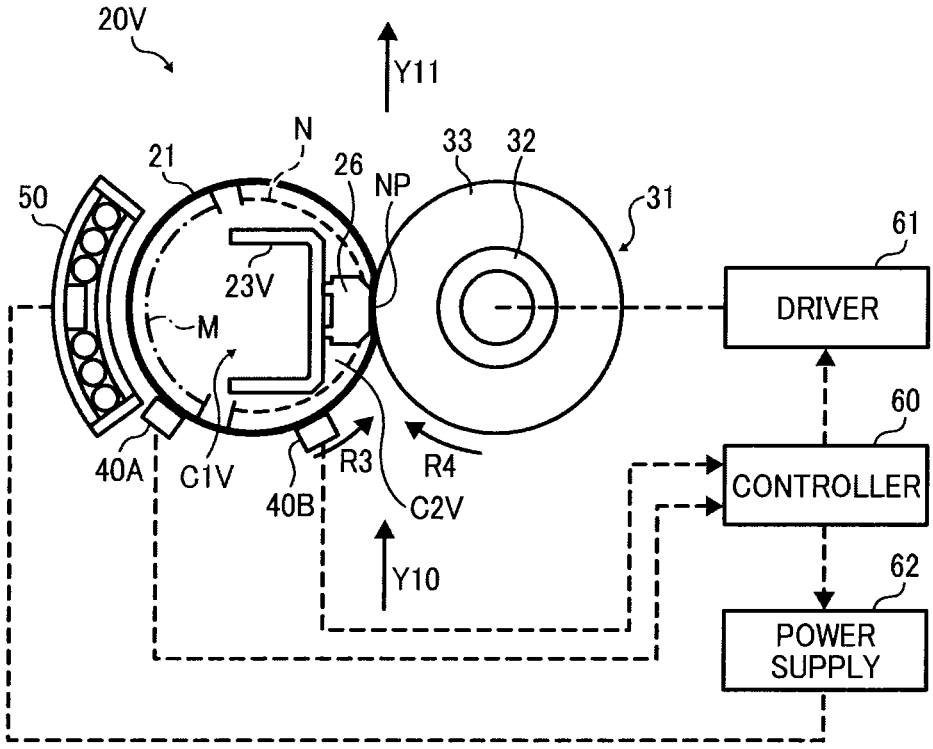
FIG. 19 is a vertical sectional view of a fixing device according to a second exemplary embodiment of the present invention.

With reference to FIG. 19, a description is provided of a configuration of a fixing device 20V according to a second exemplary embodiment.

FIG. 19 is a vertical sectional view of the fixing device 20V. The fixing device 20V includes an induction heater 50 that heats the fixing belt 21 by induction heating instead of the heater 25, that is, the halogen heater or the carbon heater, of the fixing device 20 depicted in FIG. 2.

As shown in FIG. 19, like the fixing device 20 depicted in FIG. 2, the fixing device 20V includes the fixing belt 21, the nip formation pad 26, a support 23V, and the pressing roller 31. Unlike the fixing device 20 depicted in FIG. 2, the fixing device 20V includes, instead of the heater 25, the induction heater 50 serving as a heater that heats the fixing belt 21. The induction heater 50 is disposed opposite a part of the outer circumferential surface of the fixing belt 21 in the circumferential direction thereof. Unlike the heater 25 depicted in FIG. 2 that heats the fixing belt 21 by radiation heat, the induction heater 50 heats the fixing belt 21 over the heating span M by electromagnetic induction.

The induction heater 50 is constructed of an exciting coil, a core, a coil guide, and the like. The exciting coil includes litz wire constructed of bundled thin wire that extends in the axial direction of the fixing belt 21 to cover a part of the outer circumferential surface of the fixing belt 21. The coil guide, made of heat-resistant resin, supports the exciting coil and the core. The core is a semicylinder made of ferromagnet such as ferrite that has relative permeability in a range of from about 1,000 to about 3,000. The core includes a center core and a side core that create and direct a magnetic flux toward the fixing belt 21 efficiently. The core is disposed opposite the exciting coil extending in the axial direction of the fixing belt 21. In addition to the base layer, the elastic layer, and the release layer described above with reference to FIG. 2, the fixing belt 21 includes a heat generation layer sandwiched between the elastic layer and the release layer, for example, and heated by the induction heater 50 by electromagnetic induction. Alternatively, the base layer may serve as a heat generation layer. The heat generation layer is made of metal such as nickel, stainless steel, iron, copper, cobalt, chrome, aluminum, gold, platinum, silver, tin, palladium, alloy made of two or more of those metal, or the like.

With reference to FIG. 19, a description is provided of an operation of the fixing device 20V having the construction described above.

As the fixing belt 21 is driven and rotated in the rotation direction R3, the fixing belt 21 is heated by the induction heater 50 over the heating span M disposed opposite the induction heater 50. For example, as a high frequency alternating electric current passes through the exciting coil of the induction heater 50, magnetic lines of force are generated, surrounding the fixing belt 21 alternately and bidirectionally. The magnetic lines of force generate eddy currents on a surface of the heat generation layer of the fixing belt 21 and electric resistance of the heat generation layer leads to Joule heating that heats the heat generation layer by electromagnetic induction, thus heating the fixing belt 21.

The support 23V located inside the loop formed by the fixing belt 21 produces the heating span M of the fixing belt 21 disposed opposite the induction heater 50 and heated by the induction heater 50 directly and the non-heating span N of the fixing belt 21 not disposed opposite the induction heater 50 and thereby not heated by the induction heater 50 directly. For example, the support 23V, formed in an inverted C shape in cross-section and supporting the nip formation pad 26, is situated inside the fixing belt 21, thus serving as a partition that divides the interior of the loop formed by the fixing belt 21 into two compartments, that is, a first compartment C1V facing the heating span M of the fixing belt 21 and a second compartment C2V facing the non-heating span N of the fixing belt 21.

To address this circumstance, like the fixing device 20 depicted in FIG. 2, the controller 60 of the fixing device 20V performs the temperature differential minimization control method that decreases the temperature differential between the temperature of the heated portion of the fixing belt 21 corresponding to the heating span M and the temperature of the non-heated portion of the fixing belt 21 corresponding to the non-heating span N that are created before the fixing belt 21 starts its rotation. The temperature differential minimization control method is performed while the fixing belt 21 rotates before a recording medium P enters the fixing nip NP.

Thus, deformation of the fixing belt 21 caused by variation in the temperature of the fixing belt 21 in the circumferential direction thereof is minimized.

As described above, even if the induction heater 50, serving as a heater, is disposed opposite a part of the outer circumferential surface of the fixing belt 21 in the circumferential direction thereof, the fixing device 20V employs the controller 60 that performs the temperature differential minimization control method that decreases the temperature differential between the temperature of the heated portion of the fixing belt 21 corresponding to the heating span M disposed opposite the induction heater 50 and the temperature of the non-heated portion of the fixing belt 21 corresponding to the non-heating span N that are created before the fixing belt 21 starts its rotation. The temperature differential minimization control method is performed while the fixing belt 21 rotates before a recording medium P enters the fixing nip NP. Thus, deformation of the fixing belt 21 caused by variation in the temperature of the fixing belt 21 in the circumferential direction thereof is minimized.

The fixing device 20V employs the induction heater 50 that heats the fixing belt 21 by electromagnetic induction. Alternatively, the fixing device 20V may employ a resistance heat generator that heats the fixing belt 21. For example, the resistance heat generator may contact a part of the inner circumferential surface 21 a or the outer circumferential surface of the fixing belt 21 in the circumferential direction thereof. The resistance heat generator is a laminated heater such as a ceramic heater including both lateral ends connected to a power supply. As an electric current passes through the resistance heat generator, the resistance heat generator heats itself by its electric resistance, heating the fixing belt 21 in contact with the resistance heat generator over the heating span M. In this case also, the controller 60 of the fixing device 20V performs the temperature differential minimization control method that decreases the temperature differential between the temperature of the heated portion of the fixing belt 21 corresponding to the heating span M disposed opposite the resistance heat generator and the temperature of the non-heated portion of the fixing belt 21 corresponding to the non-heating span N that are created before the fixing belt 21 starts its rotation. The temperature differential minimization control method is performed while the fixing belt 21 rotates before a recording medium P enters the fixing nip NP. Thus, deformation of the fixing belt 21 caused by variation in the temperature of the fixing belt 21 in the circumferential direction thereof is minimized.

With reference to FIGS. 2, 4, 15, 17, 18, and 19, a description is provided of the advantages of the fixing device (e.g., the fixing devices 20, 20S, 20T, 20U, and 20V).

The fixing device includes a fixing rotary body (e.g., the fixing belt 21) rotatable in a predetermined direction of rotation (e.g., the rotation direction R3) to heat and melt a toner image T on a recording medium P; a pressing rotary body (e.g., the pressing roller 31) pressingly contacting the outer circumferential surface of the fixing rotary body to form the fixing nip NP therebetween through which the recording medium P is conveyed; and a heater (e.g., the heater 25 and the induction heater 50) disposed opposite a part of the inner circumferential surface 21*a* or the outer circumferential surface of the fixing rotary body in the circumferential direction thereof to heat the fixing rotary body over that part. The fixing device further includes the controller 60 that performs the temperature differential minimization control method that decreases the temperature differential between the temperature of the heated portion of the fixing rotary body corresponding to the heating span M disposed opposite the heater and the temperature of the non-heated portion of the fixing rotary body corresponding to the non-heating span N adjacent to the heating span M that are created before the fixing rotary body starts its rotation. The temperature differential minimization control method is performed while the fixing rotary body rotates before the recording medium P enters the fixing nip NP.

Accordingly, even if the heater is disposed opposite a part of the inner circumferential surface 21 a or the outer circumferential surface of the fixing rotary body in the circumferential direction thereof, the fixing device employs the controller 60 that performs the temperature differential minimization control method that decreases the temperature differential between the temperature of the heated portion of the fixing rotary body corresponding to the heating span M disposed opposite the heater and the temperature of the non-heated portion of the fixing rotary body corresponding to the non-heating span N disposed opposite the heater via a partition (e.g., the supports 23, 23T, and 23V) that blocks light radiated from the heater, that are created before the fixing rotary body starts its rotation. The temperature differential minimization control method is performed when the fixing rotary body rotates in the rotation direction R3 while no recording medium P is conveyed through the fixing nip NP. Thus, the fixing device and the image forming apparatus 1 incorporating the fixing device minimize deformation of the fixing rotary body caused by variation in the temperature of the fixing rotary body in the circumferential direction thereof.

According to the exemplary embodiments described above, the fixing belt 21 constructed of the plurality of layers is used as a fixing rotary body. Alternatively, an endless fixing film made of polyimide, polyamide, fluoroplastic, metal, or the like may be used as a fixing rotary body. Yet alternatively, a fixing roller constructed of a hollow metal core, an elastic layer coating the metal core, and a surface layer coating the elastic layer may be used as a fixing rotary body. Further, according to the exemplary embodiments described above, the pressing roller 31 is used as a pressing rotary body. Alternatively, an endless pressing belt may be used as a pressing rotary body. Those alternative fixing rotary body and pressing rotary body also attain the advantages of the fixing devices 20, 20S, 20T, 20U, and 20V described above. Moreover, according to the exemplary embodiments described above, the supports 23, 23T, and 23V are used as a partition. Alternatively, a reflector located inside the fixing rotary body may be used as a partition.

According to the exemplary embodiments described above, a state in which the nip formation pad (e.g., the nip formation pad 26) and the partition (e.g., the supports 23, 23T, and 23V) are mounted on the flanges 29 or the side plates 43 defines a state in which the nip formation pad and the partition are not rotatable. For example, even if the nip formation pad is biased against the pressing roller 31 by a biasing member such as a spring, the nip formation pad is defined as being mounted on the flanges 29 as long as the nip formation pad is not rotatable.

According to the exemplary embodiments described above, the width direction of the recording medium P defines a direction perpendicular to the recording medium conveyance directions Y10 and Y11 and parallel to the axial direction of the fixing belt 21 and the pressing roller 31.

According to the exemplary embodiments described above, the controller 60 controls the power supply 62 to supply power to the heater 25 in step S13 depicted in FIG. 7, step S25 depicted in FIG. 9, and step S53 depicted in FIG. 14 after starting rotation of the fixing belt 21 in step S12 depicted in FIG. 7, step S24 depicted in FIG. 9, and step S52 depicted in FIG. 14. Alternatively, the controller 60 may control the power supply 62 to supply power to the heater 25 substantially simultaneously with starting rotation of the fixing belt 21. Yet alternatively, the controller 60 may control the power supply 62 to supply power to the heater 25 before rotating the fixing belt 21.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a hollow, fixing rotary body rotatable in a predetermined direction of rotation;

a pressing rotary body pressingly contacting an outer circumferential surface of the fixing rotary body to form a fixing nip therebetween through which a recording medium bearing a toner image is conveyed;

a partition disposed inside the fixing rotary body to divide an interior of the fixing rotary body into a first compartment facing a heating span of the fixing rotary body spanning in a circumferential direction thereof and a second compartment facing a non-heating span of the fixing rotary body adjacent to the heating span;

a heater disposed opposite and heating the heating span of the fixing rotary body;

a power supply connected to the heater to supply power to the heater;

a driver connected to the fixing rotary body to rotate the fixing rotary body; and a controller operatively connected to the power supply and the driver to control the power supply and the driver, the controller to perform at least one of a rotation speed control that controls the driver to rotate the fixing rotary body at an increased rotation speed and a power supply control that controls the power supply to supply an increased amount of power to the heater to decrease temperature differential between a temperature of the heating span of the fixing rotary body and a temperature of the non-heating span of the fixing rotary body.

2. The fixing device according to claim 1, wherein the controller controls the driver to rotate the fixing rotary body at the increased rotation speed for a predetermined time after the driver starts rotating the fixing rotary body before the recording medium enters the fixing nip.

3. The fixing device according to claim 2, further comprising:

a first temperature detector disposed opposite the heating span of the fixing rotary body to detect a first temperature of the heating span of the fixing rotary body; and a second temperature detector disposed opposite the non-heating span of the fixing rotary body to detect a second temperature of the non-heating span of the fixing rotary body, wherein the controller controls the driver to rotate the fixing rotary body at the increased rotation speed when the first temperature is greater than the second temperature by a predetermined temperature differential.

4. The fixing device according to claim 3, wherein the predetermined temperature differential is not smaller than about 100 degrees centigrade.

5. The fixing device according to claim 1, wherein the controller controls the power supply to supply the increased amount of power to the heater for a predetermined time.

6. The fixing device according to claim 5, wherein the controller controls the power supply to supply the increased amount of power to the heater for the predetermined time when a non-heated portion of the fixing rotary body corresponding to the non-heating span of the fixing rotary body moves to the heating span of the fixing rotary body as the fixing rotary body rotates.

7. The fixing device according to claim 5, further comprising:

a first temperature detector disposed opposite the heating span of the fixing rotary body to detect a first temperature of the heating span of the fixing rotary body; and a second temperature detector disposed opposite the non-heating span of the fixing rotary body to detect a second temperature of the non-heating span of the fixing rotary body, wherein the controller controls the power supply to supply the increased amount of power to the heater when the first temperature is greater than the second temperature by a predetermined temperature differential.

8. The fixing device according to claim 7, wherein the predetermined temperature differential is not smaller than about 100 degrees centigrade.

9. The fixing device according to claim 5, wherein the controller controls the power supply to supply the increased amount of power to the heater for the predetermined time after the driver starts rotating the fixing rotary body before the recording medium enters the fixing nip.

10. The fixing device according to claim 1, further comprising a deformation detector disposed opposite the outer circumferential surface of the fixing rotary body to detect deformation of the fixing rotary body, wherein the controller performs at least one of the rotation speed control and the power supply control when the deformation detector detects deformation of the fixing rotary body.

11. The fixing device according to claim 10, wherein the deformation detector includes:

a lever contacting the outer circumferential surface of the fixing rotary body and pivotable in a predetermined direction of pivoting;

a shaft to pivotably support the lever; and a photo sensor disposed in proximity to the lever and operatively connected to the controller, and wherein as the fixing rotary body deforms, the lever is pivoted about the shaft by the deformed fixing rotary body and brought into contact with the photo sensor.

12. The fixing device according to claim 1, further comprising a nip formation pad disposed inside the fixing rotary body and pressing against the pressing rotary body via the fixing rotary body, wherein the partition includes a support to contact and support the nip formation pad, and wherein the heater is situated in the first compartment of the fixing rotary body.

13. The fixing device according to claim 12, wherein the heater is disposed opposite the nip formation pad via the partition.

14. The fixing device according to claim 1, wherein the first compartment of the fixing rotary body is disposed upstream from the fixing nip in the direction of rotation of the fixing rotary body.

15. The fixing device according to claim 1, further comprising a substantially tubular, metal heat conductor disposed opposite an inner circumferential surface of the fixing rotary body, wherein the heater is disposed opposite and heats the fixing rotary body via the metal heat conductor.

16. The fixing device according to claim 1, wherein the heater includes an induction heater disposed opposite the outer circumferential surface of the fixing rotary body.

17. The fixing device according to claim 1, wherein the partition is substantially W-shaped in cross-section.

18. An image forming apparatus comprising the fixing device according to claim 1.

19. A fixing method performed by a fixing device including a hollow, fixing rotary body and a partition dividing an interior of the fixing rotary body into a first compartment accommodating a heater and a second compartment, the fixing method comprising the steps of:

powering on the fixing device;

rotating the fixing rotary body at a first rotation speed;

supplying power to the heater;

determining whether or not a predetermined time has elapsed after starting rotation of the fixing rotary body at the first rotation speed; and rotating the fixing rotary body at a second rotation speed smaller than the first rotation speed after the predetermined time has elapsed.

20. A fixing method performed by a fixing device including a hollow, fixing rotary body and a partition dividing an interior of the fixing rotary body into a first compartment accommodating a heater and a second compartment, the fixing method comprising the steps of:

powering on the fixing device;

supplying a first amount of power to the heater;

rotating the fixing rotary body by half period of rotation; and supplying a second amount of power greater than the first amount of power to the heater.

* * * * *